US007114824B2

(12) United States Patent
Picone

(10) Patent No.: US 7,114,824 B2
(45) Date of Patent: Oct. 3, 2006

(54) MULTI-FUNCTIONAL TOOL WITH INTERCHANGEABLE ADJUSTABLE WRENCH HEAD UNIT

(75) Inventor: John Picone, Oceanside, NY (US)

(73) Assignee: Picone Products, Inc., Oceanside, NY (US)

( * ) Notice: Subject to any disclaimer, the term of this patent is extended or adjusted under 35 U.S.C. 154(b) by 25 days.

(21) Appl. No.: 10/836,378

(22) Filed: May 3, 2004

(65) Prior Publication Data

US 2005/0243553 A1 Nov. 3, 2005

(51) Int. Cl.
*F21V 33/00* (2006.01)
*B25B 23/18* (2006.01)

(52) U.S. Cl. ..... 362/119; 362/120; 362/109; 81/165; 81/170; 81/57

(58) Field of Classification Search ..... 362/119, 362/253, 120, 109; 81/165, 170, 54, 57.21, 81/155

See application file for complete search history.

(56) References Cited

U.S. PATENT DOCUMENTS

| | | | | | |
|---|---|---|---|---|---|
| 924,269 | A | | 6/1909 | Paterson | |
| 1,456,290 | A | | 5/1923 | Tell | |
| 2,544,058 | A | | 3/1951 | Watkins | |
| 3,555,939 | A | * | 1/1971 | Halls | 81/165 |
| 3,948,120 | A | * | 4/1976 | Hancock | 81/165 |
| 4,512,221 | A | | 4/1985 | Picone | |
| 4,729,281 | A | | 3/1988 | Holloway, Jr. et al. | |
| 4,831,903 | A | | 5/1989 | Dausey et al. | |
| 4,960,016 | A | | 10/1990 | Seals | |
| 5,345,636 | A | | 9/1994 | Lamons | |
| 5,682,802 | A | * | 11/1997 | Mazzone | 81/127 |
| 5,685,208 | A | | 11/1997 | Tidwell | |
| 6,016,728 | A | | 1/2000 | Bohl et al. | |
| 6,033,081 | A | * | 3/2000 | Huang | 362/119 |
| 6,135,608 | A | * | 10/2000 | Lin | 362/119 |
| 6,334,693 | B1 | * | 1/2002 | Lee | 362/119 |
| 6,477,921 | B1 | | 11/2002 | Picone | |
| 6,712,484 | B1 | * | 3/2004 | Hsien | 362/119 |
| 6,748,826 | B1 | * | 6/2004 | Marks | 81/165 |
| 6,966,242 | B1 | * | 11/2005 | Picone | 81/165 |
| 2003/0066167 | A1 | | 4/2003 | Huang | |
| 2005/0068764 | A1 | * | 3/2005 | Chen | 362/119 |

FOREIGN PATENT DOCUMENTS

| | | |
|---|---|---|
| DE | 849 080 C | 11/1952 |
| DE | 44 46 503 C1 | 5/1996 |

(Continued)

*Primary Examiner*—Ali Alavi
*Assistant Examiner*—Jacob Y. Choi
(74) *Attorney, Agent, or Firm*—Berenato, White & Stavish

(57) ABSTRACT

A multi-functional tool comprising an extendable power tool handle unit with an interchangeable connect feature able to receive and power various size interchangeable, adaptable adjustable wrench head units and other adaptable tool attachments. The interchangeable wrench head units are easily connected and disconnected to the power tool handle unit. Each interchangeable adjustable wrench head unit has a self-contained transmission connectible to and powered by the adaptive power handle unit. The interchangeable wrench head units comprise of a moveable jaw, a stationary jaw, and a worm gear. The worm gear is meshed with a rack of the moveable jaw and the worm gear is driven by a motor and transmission. Activation of the motor produces linear reciprocating motion of the adjustable jaw. A power source from the handle provides the power to a control switch. The switch controls the function of the adjustable wrench heads and other powered tool attachments.

130 Claims, 23 Drawing Sheets

FOREIGN PATENT DOCUMENTS

| | | | |
|---|---|---|---|
| EP | 0 841 125 A | 5/1998 | |
| GB | 434025 | 8/1935 | |

* cited by examiner

Fig. 6
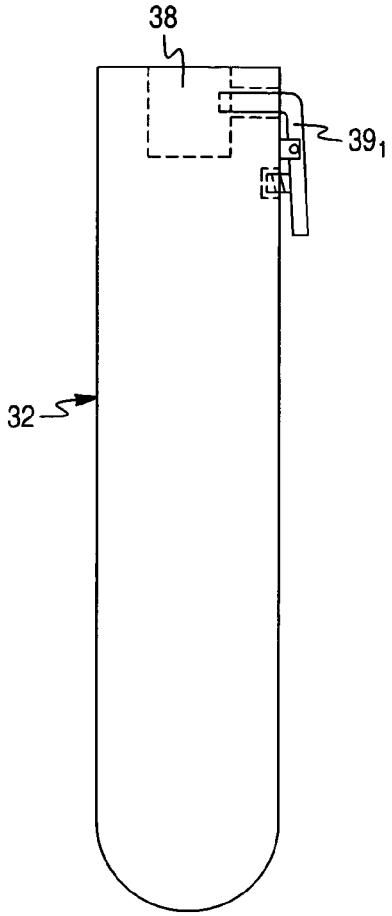
Fig. 7A
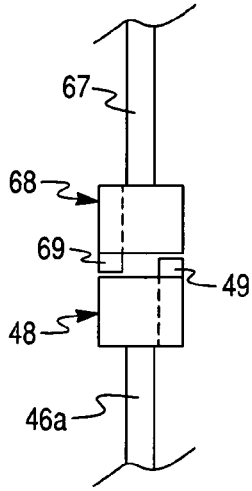
Fig. 7B
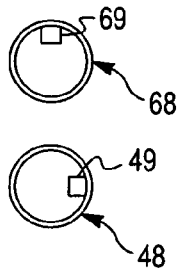
Fig. 7C
Fig. 8A
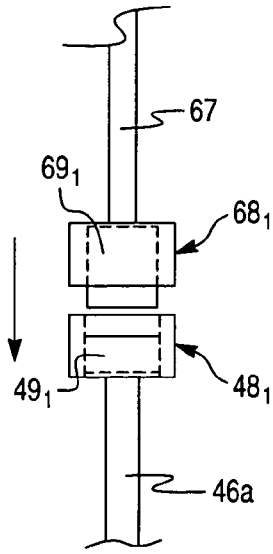
Fig. 8B
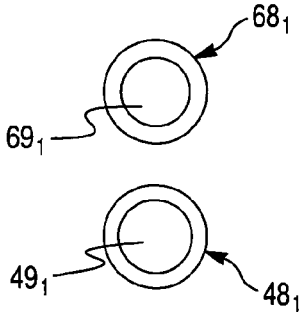
Fig. 8C Fig. 9A
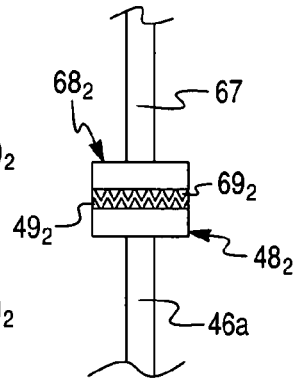
Fig. 9B
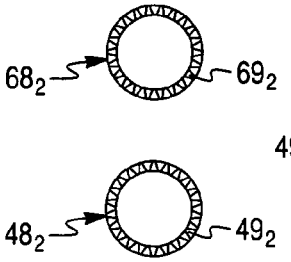
Fig. 9C
Fig. 10A
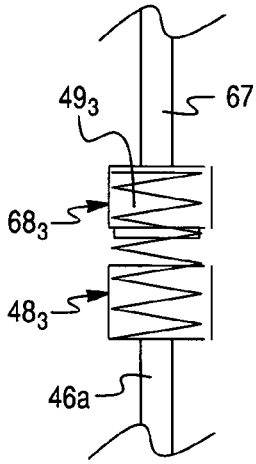
Fig. 10B
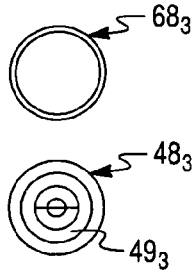
Fig. 10C
Fig. 11A
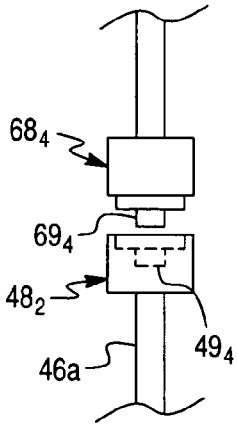
Fig. 11B
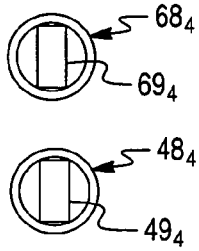
Fig. 11C Fig. 12A
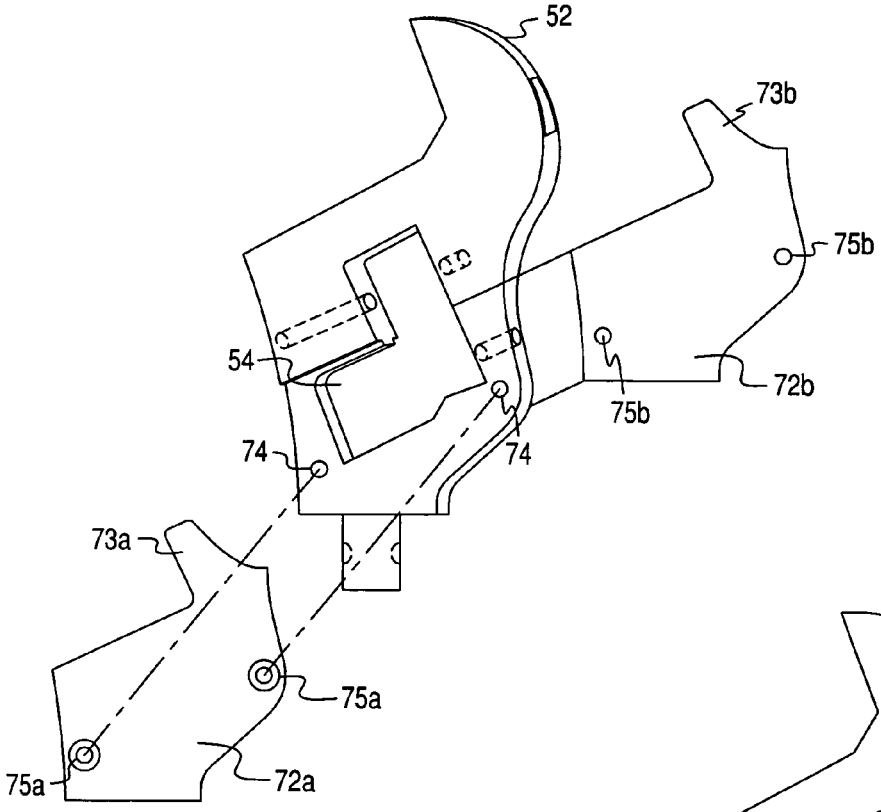
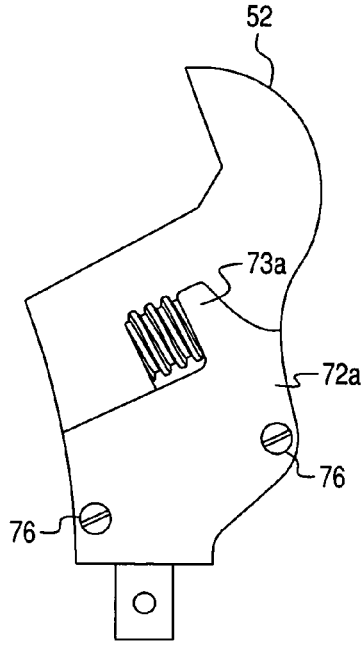
Fig. 12B Fig. 16A
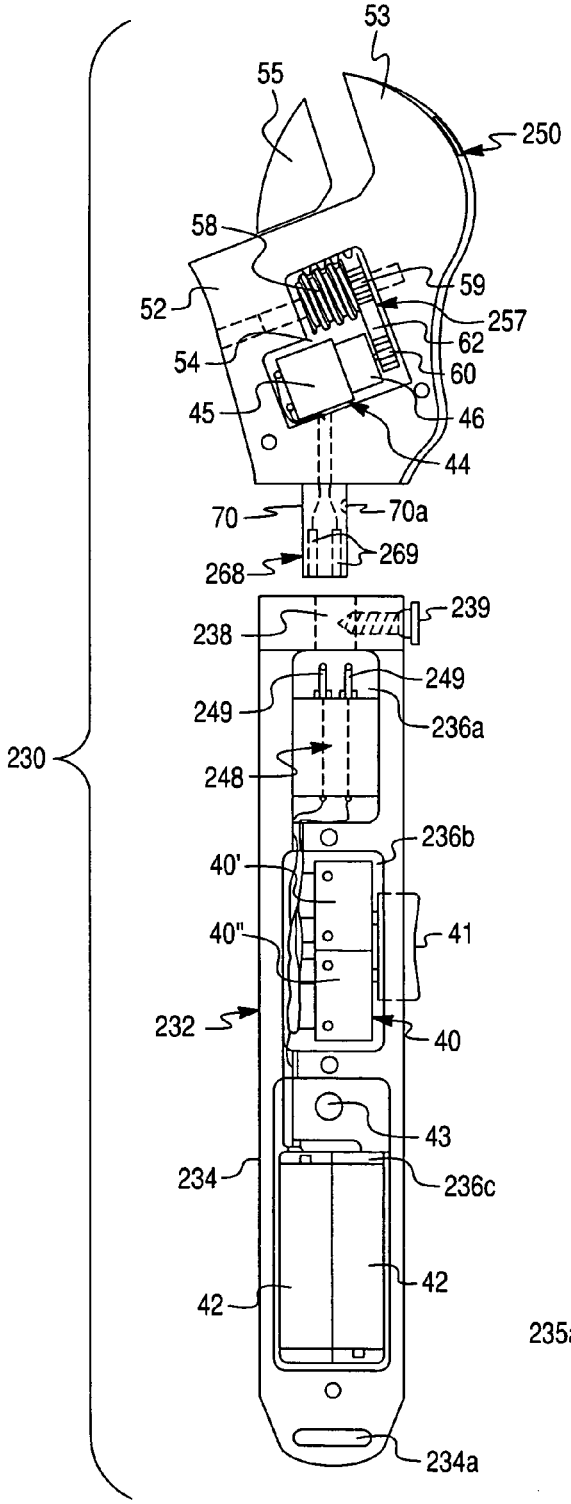
Fig. 16B
Fig. 16C
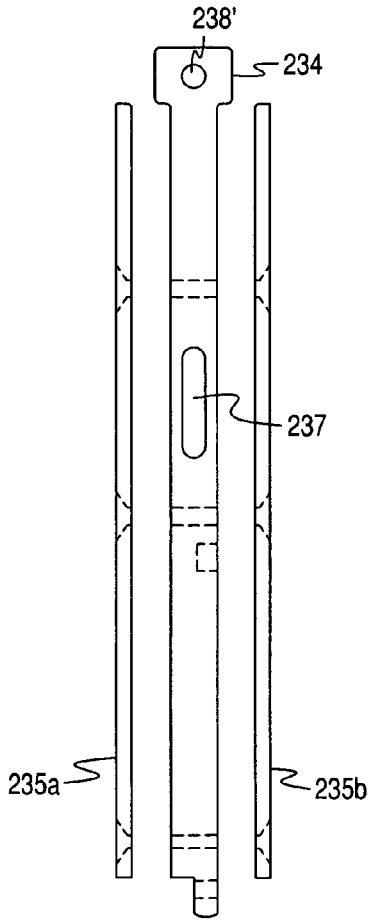

Fig. 17A
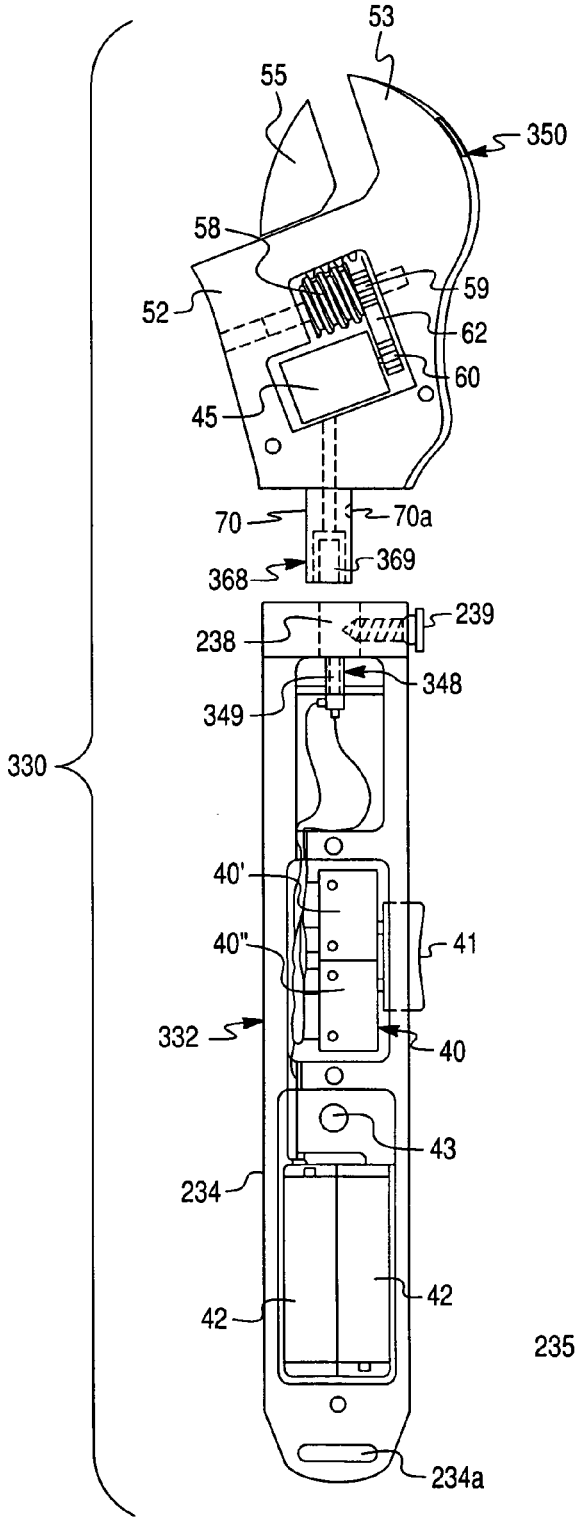
Fig. 17B
Fig. 17C
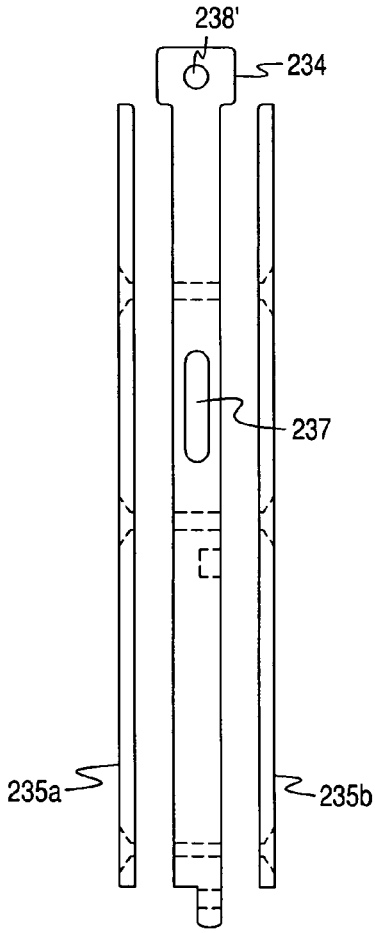

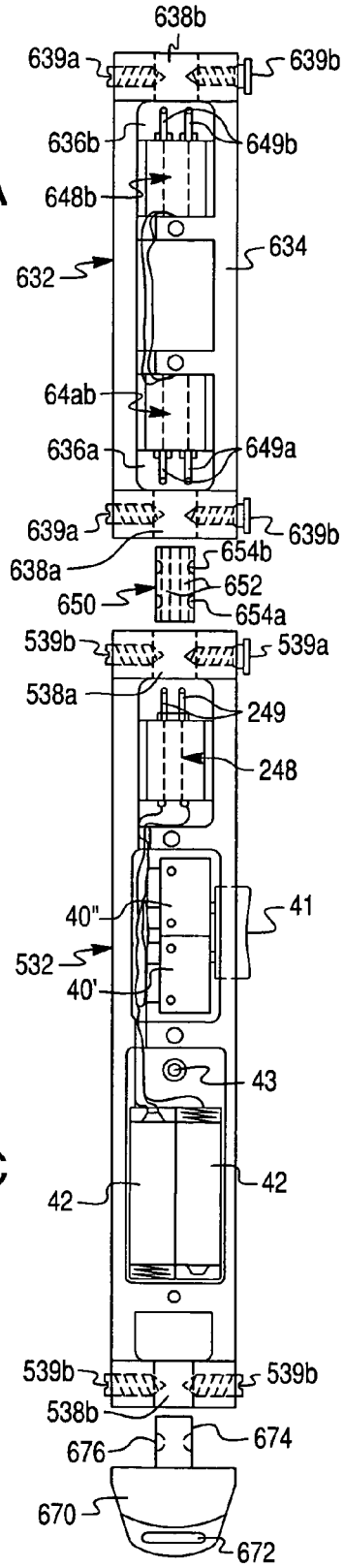
Fig. 20A
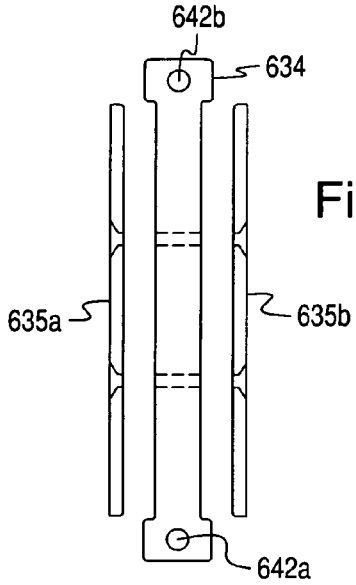
Fig. 20B
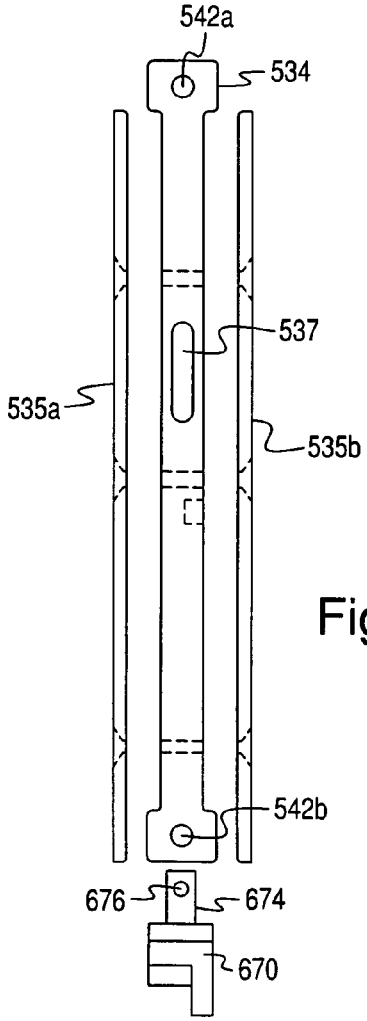
Fig. 20C
Fig. 20D

Fig. 21A
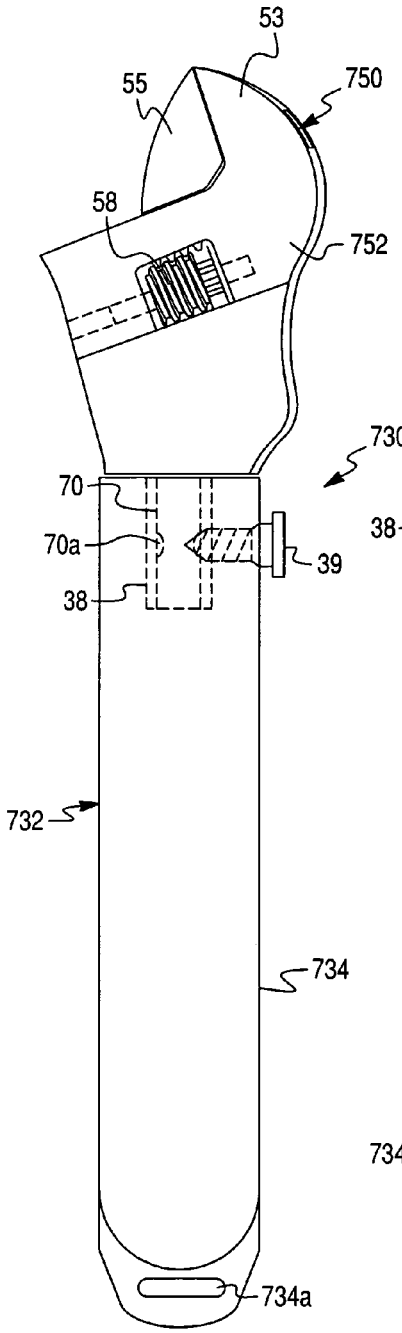
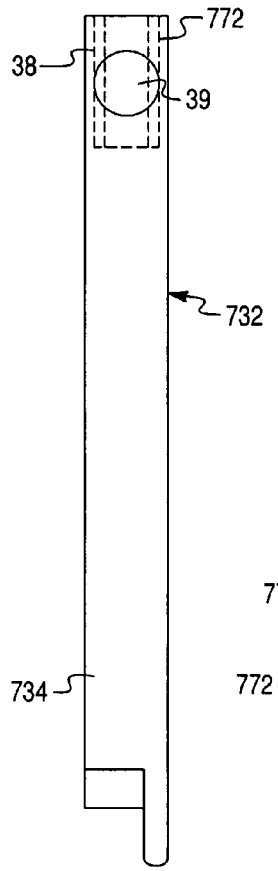
Fig. 21B
Fig. 21C
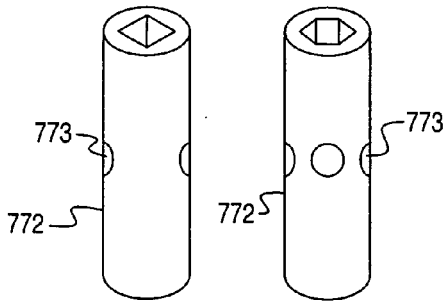
Fig. 21D

Fig. 22A
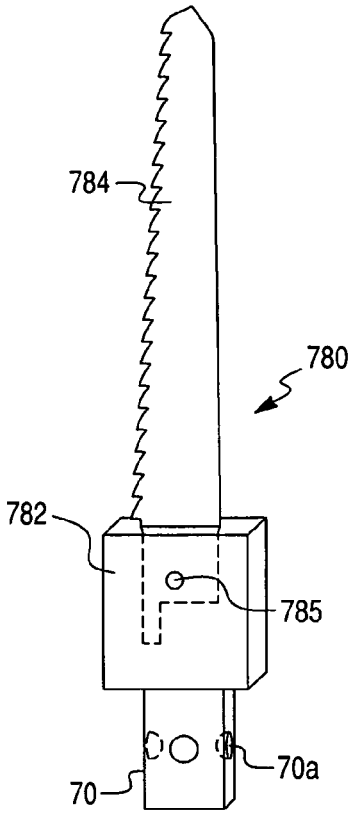
Fig. 22B
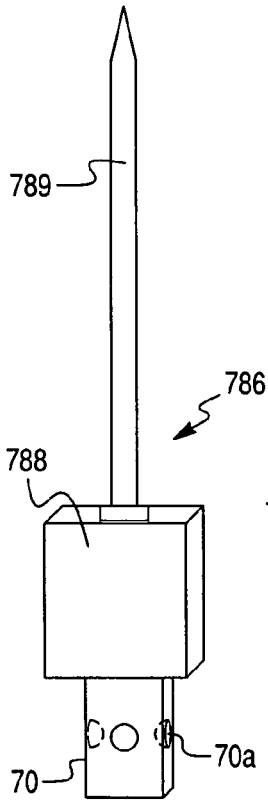
Fig. 22C
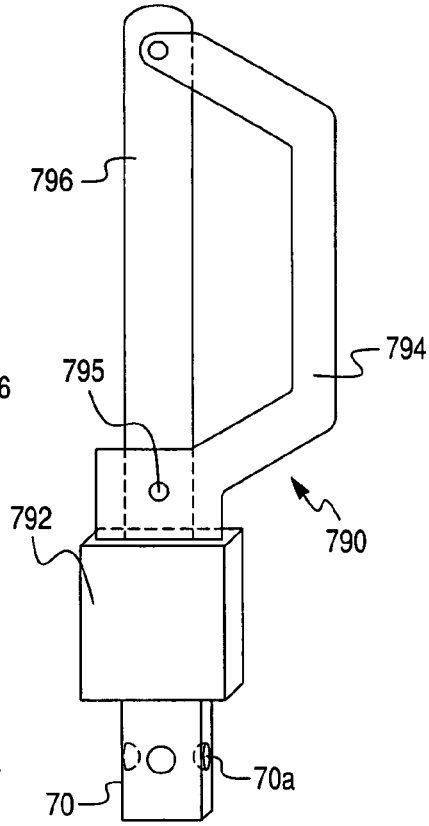
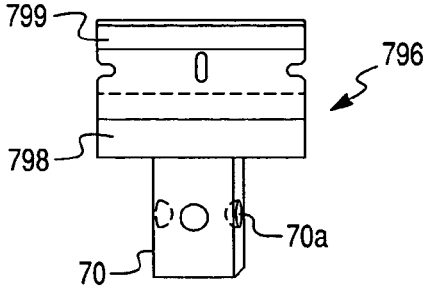
Fig. 22D
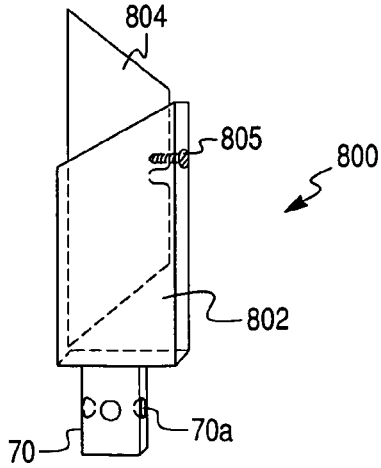
Fig. 22E 53
55
950
58
52
59
62
957
60
54
945
946
944
71
70
969
70a
968
938
947
939
949
46
948
44
48
45
930
40
40'
41
40"
932
42
934
42
970
43
938'
938
937
935
934
970
43

MULTI-FUNCTIONAL TOOL WITH INTERCHANGEABLE ADJUSTABLE WRENCH HEAD UNIT

BACKGROUND OF THE INVENTION

1. Field of the Invention

The present invention relates broadly to power tools and, more particularly, to a multi-functional power tool having a removable and interchangeable adjustable wrench head with a sliding jaw.

2. Description of the Prior Art

A powered adjustable jaw wrench having a sliding jaw and a stationary jaw is known in the prior art. As illustrated in FIG. 1, the powered adjustable jaw wrench 10 of the prior art comprises a wrench body 11 including a wrench body member 12 provided with an integral stationary jaw 15, and a handle cover 16, a moveable jaw 17 adjustable relative to the stationary jaw 15. A handle portion 13 and a head portion 14 of the wrench body member 12 form a unitary single-piece part. A worm gear 19 and a sprocket 18 rotatable mounted in the head portion 14 of the wrench body member 12 coaxially with respect to each other. The worm gear 19 is operably connected to a toothed rack of the moveable jaw 17 so that the rotatable movement of the worm gear 19 is transformed into linear movement of the moveable jaw 17.

The prior art powered adjustable jaw wrench 10 further includes a drive mechanism: a motor 22, a sprocket 21, a drive belt 20, and control switch assembly 25, a switch actuator 26, and a power source 27 all housed in the unitary single-piece part wrench body member 12.

As further illustrated in FIG. 2, an exploded view of the prior art detailing the handle portion 13 and the head portion 14 of the wrench body member 12 form a unitary single-piece part. Wrench body member 12 is provided with compartment openings 22, 23 and 24 housing the electric motor 22, the control switch assembly 25 and the electric batteries 27, respectively.

Therefore, the powered adjustable wrenches of the prior art are made of a unitary single-piece body member having an integral elongated handle portion and a head portion contain the motor, switch, batteries and power transmission integrally in the unitary design for each size powered adjustable wrench manufactured. Each prior art powered adjustable wrench is a single unit and by design is limited to the individual size and characteristic of its jaw opening. Thus, when the size of the powered wrench jaw is not accommodating to the size of the work, a user will have to seek a larger powered wrench to perform the work. In the prior art, it is necessary to have a few individually powered wrenches on hand to perform various sizes of work. The portability of carrying a few powered wrenches in a tool belt is both cumbersome and weight restrictive. Prior art powered adjustable wrenches do not possess a rotating head feature to accommodate various work angles. Prior art powered adjustable wrenches do not have means for detachable heads and handles, nor do they have extendable handles for reach and leverage.

SUMMARY OF THE INVENTION

The present invention is an improvement over the adjustable jaw wrench of the prior art disclosed in U.S. Pat. Nos. 4,512,221 and 6,477,921 and in U.S. patent application Ser. No. 10/726,646 filed Dec. 4, 2003 by John A. Picone incorporated herein by reference.

It is therefore an object of the present invention to provide for a novel and improved multi-functional tool with interchangeable head units.

In accordance with the present invention, the multi-functional tool comprises a tool handle unit including a handle body member having a fitting portion, and a first tool head unit removably attachable to the handle unit. The first head unit has a fitting member provided to matingly engage the fitting portion of the handle unit so as to removably secure the first head unit to the handle unit. Preferably, the first head unit is an adjustable jaw wrench comprising a head body member defining a stationary jaw, a movable jaw reciprocally mounted to the head body member in alignment with the stationary jaw and including a gear rack portion, and a drive mechanism mounted to the head body member of the first head unit. The drive mechanism is operably coupled to the movable jaw for moving the movable jaw relative to the stationary jaw. The drive mechanism includes a worm gear rotatably mounted in the head body and engaging said gear rack portion of the movable jaw.

The adjustable wrench head unit incorporates a self-contained drive transmission that turn the worm gear to produce the linear movement of the sliding jaw. The adjustable wrench heads have an integral bottom "post" or "stem" that fits into a reciprocal mating area or "seat" of the power wrench handle. The tool handle unit incorporates means to quick connect and disconnect wrench heads between the post and seat by way of a spring loaded pin or ball, or by a locking device means such as a spring plunger, threaded fastener, cam lock, or a ratchet pawl located at the top portion of the handle. An electrical energy in the tool handle provides power to a control switch and an electric motor.

In accordance with the first exemplary embodiment of the present invention, power is transferred from the handle to the head via a mechanical coupling device or a receptacle-coupling device shared between the two members. The control switch on the handle controls the function of the power heads.

In accordance with the first exemplary embodiment of the present invention, the motor is located in the power handle unit and power from the motor is transferred from the handle to the adjustable wrench head via a mechanical coupling device and shaft shared between the two components. Rotating torque from the motor is transferred to the transmission drive in the adjustable wrench head that rotates the worm gear and, the worm gear is meshed with the rack of the moveable jaw producing linear movement of the sliding jaw. The control switch on the handle controls the function of the power heads.

In accordance with the second, third, fourth, fifth and sixth exemplary embodiments of the present invention the electric motor and transmission is incorporated in the interchangeable adjustable wrench head unit where power from the handle unit is transferred to the head unit through an electrical coupling device shared between the two components.

The fifth and sixth exemplary embodiments of the present invention are adaptable power tool handles and extension tool handles which are used to power interchangeable heads and, to connect to one another to form longer handles to facilitate extended reach and leverage as needed.

The seventh exemplary embodiment of the present invention is a manually operated interchangeable wrench head and adaptive tool handle adapted to be removably connected to interchangeable tool head units utilized with the adaptive tool handle of the seventh exemplary embodiment of the present invention.

The eighth exemplary embodiment of the present invention is a power tool handle including both a mechanical handle coupling device and an electric handle connector combined in the one tool handle unit. Rotating torque and electrical power can be simultaneously transferred from the power tool handle unit to the interchangeable head units as desired. Two separate switches are provided on the power tool handle unit to control multiple functions of various integrated head units.

The principal advantage for the present invention is to provide for a unique power wrench system utilizing a common power handle with a set of variable size wrench head units. It is much easier to transport one handle and a few wrench head units in a tool belt than to carry around several cumbersome wrenches with handles in the same fashion. The variable size wrench head units can be constructed of materials to adapt to the work application such as a non-sparking wrench head made of zinc alloy, aluminum or aluminum bronze, a steel wrench head for heavy-duty work and a composite plastic wrench head for sensitive fittings requiring light duty tightening.

The present invention is further adapted to select and rotate the position of the wrench head unit relative to a switch actuator of the tool handle unit. The rotating wrench head feature has its major advantages when the angle of the work related to the wrench head unit is most difficult to achieve, and when the user encounters a tight spot and hand access is limited. Rotation of the head unit in relation to the handle unit and switch actuator facilitates a correct and true right hand or left hand use of the adjustable wrench head unit. Detents incrementally spaced around the perimeter of the bottom post facilitate indexing and receive a pin, ball, ratchet or fastener to lock the desired position of the rotating wrench head unit.

The present invention power tool handle of the present invention is a versatile power source and has interchangeability characteristics that can adapt and control other various tool attachments for drilling, mixing, clamping, tightening and grabbing. The tool handle unit can be made of various materials such as zinc alloy, aluminum, aluminum bronze, steel or plastic or a combination thereof. The power source media stored in or to the handle unit can be that of batteries or any type of fluid pressure.

One skilled in the arts realizes the present invention includes the use and benefits of a similarly non-powered handle and manually operable interchangeable wrench head units with all the features described herein.

BRIEF DESCRIPTION OF THE DRAWINGS

Other objects and advantages of the invention will become apparent from a study of the following specification when viewed in light of the accompanying drawings, wherein:

FIG. 6 is a side view of a spring detent plunger of a tool handle unit in accordance with the present invention;

FIG. 7A is a side view of a handle coupling device and a complementary head coupling device in accordance with a first exemplary embodiment thereof;

FIG. 7B is a front view of the head coupling device in accordance with the first exemplary embodiment thereof;

FIG. 7C is a front view of the handle coupling device in accordance with the first exemplary embodiment thereof;

FIG. 8A is a side view of a handle coupling device and a complementary head coupling device in accordance with a second exemplary embodiment thereof;

FIG. 8B is a front view of the head coupling device in accordance with the second exemplary embodiment thereof;

FIG. 8C is a front view of the handle coupling device in accordance with the second exemplary embodiment thereof;

FIG. 9A is a side view of a handle coupling device and a complementary head coupling device in accordance with a third exemplary embodiment thereof;

FIG. 9B is a front view of the head coupling device in accordance with the third exemplary embodiment of the present invention;

FIG. 9C is a front view of the handle coupling device in accordance with the third exemplary embodiment thereof;

FIG. 10A is a side view of a handle coupling device and a complementary head coupling device in accordance with a fourth exemplary embodiment thereof;

FIG. 10B is a front view of the head coupling device in accordance with the fourth exemplary embodiment thereof;

FIG. 10C is a front view of the handle coupling device in accordance with the fourth exemplary embodiment thereof;

FIG. 11A is a side view of a handle coupling device and a complementary head coupling device in accordance with a fifth exemplary embodiment thereof;

FIG. 11B is a front view of the head coupling device in accordance with the fifth exemplary embodiment thereof;

FIG. 11C is a front view of the handle coupling device in accordance with the fifth exemplary embodiment thereof;

FIG. 12A is an exploded perspective view of the interchangeable powered adjustable jaw wrench head unit in accordance with the first exemplary embodiment of the present invention having two cover members;

FIG. 12B is a perspective view of the interchangeable powered adjustable jaw wrench head unit in accordance with the first exemplary embodiment of the present invention provided with two cover members;

FIG. 16A is a side view of a first interchangeable powered adjustable jaw wrench head unit in accordance with a second exemplary embodiment of the present invention;

FIG. 16B is a side view of a power tool handle unit in accordance with the second exemplary embodiment of the present invention;

FIG. 16C is an exploded front view of the handle body member and handle covers of the power tool handle unit in accordance with the second embodiment of the present invention;

FIG. 17A is a side view of a first interchangeable powered adjustable jaw wrench head unit in accordance with a third exemplary embodiment of the present invention;

FIG. 17B is a side view of a power tool handle unit in accordance with the third exemplary embodiment of the present invention;

FIG. 17C is an exploded front view of the handle body member and handle covers of the power tool handle unit in accordance with the third embodiment of the present invention;

FIG. 20A is a side view of an extension tool handle of a power tool in accordance with the sixth exemplary embodiment of the present invention;

FIG. 20B is an exploded side view of a handle body member of the extension tool handle of the power tool in accordance with the sixth exemplary embodiment of the present invention;

FIG. 20C is a side view of a power tool handle unit of the power tool in accordance with the sixth exemplary embodiment of the present invention;

FIG. 20D is an exploded side view of a handle body member of the power tool in accordance with the sixth exemplary embodiment of the present invention;

FIG. 21A is a side view of a multi-functional tool including an interchangeable adjustable jaw wrench head unit and tool handle unit in accordance with the seventh exemplary embodiment of the present invention;

FIG. 21B is a side view of a tool handle unit in accordance with the seventh exemplary embodiment of the present invention;

FIGS. 21C and 21D are perspective side views of hole sleeves for the multi-functional tool in accordance with the seventh exemplary embodiment of the present invention;

FIG. 22A is a side view of a second interchangeable tool head unit for the multi-functional tool in accordance with the seventh exemplary embodiment of the present invention;

FIG. 22B is a side view of a third interchangeable tool head in accordance with the seventh exemplary embodiment of the present invention;

FIG. 22C is a side view of a fourth interchangeable tool head in accordance with the seventh exemplary embodiment of the present invention;

FIG. 22D is a side view of a fifth interchangeable tool head in accordance with the seventh exemplary embodiment of the present invention;

FIG. 22E is a side view of a sixth interchangeable tool head in accordance with the seventh exemplary embodiment of the present invention;

DETAILED DESCRIPTION OF PREFERRED EMBODIMENTS

The preferred embodiments of the present invention will now be described with the reference to accompanying drawings.

Figure 1:
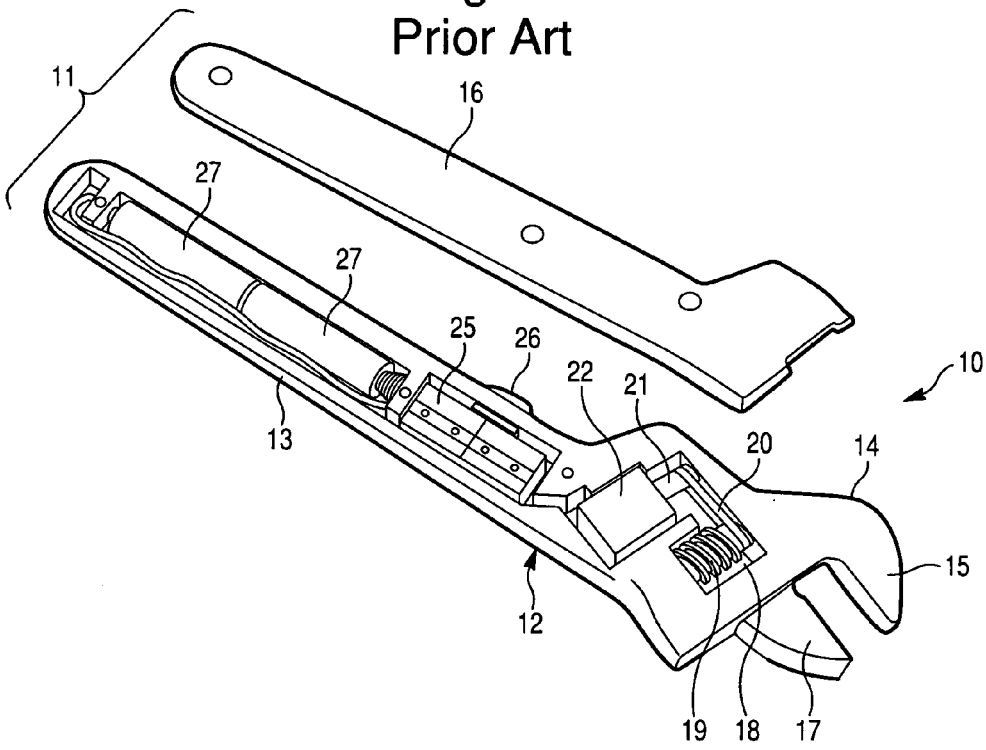
Fig. 1 Prior Art
FIG. 1 is a perspective view showing a powered adjustable jaw wrench of the prior art.
Figure 2:
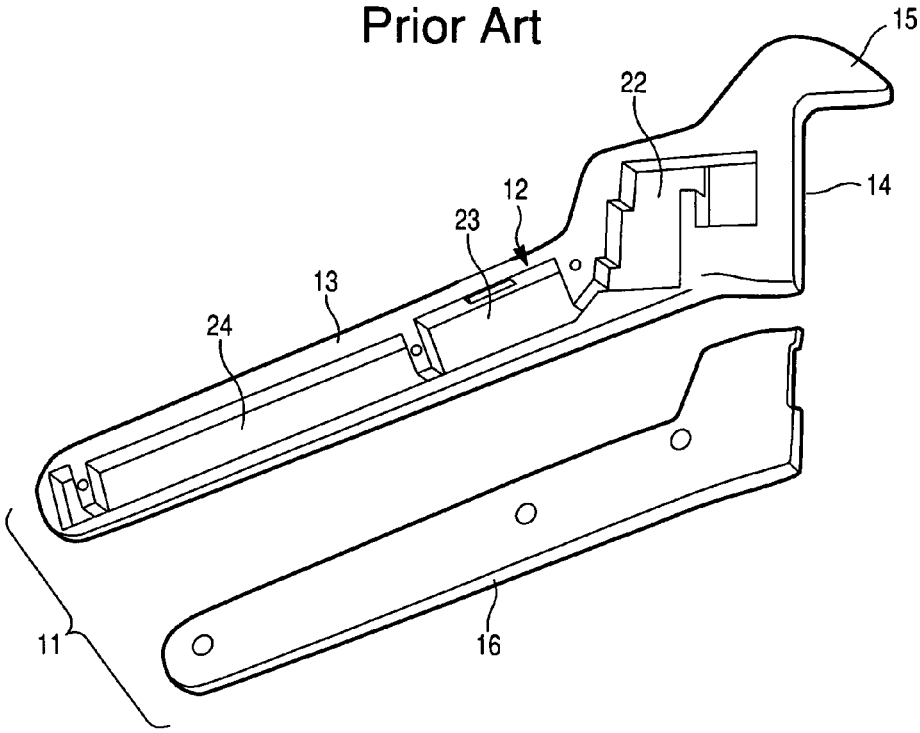
Fig. 2 Prior Art
FIG. 2 is an exploded perspective view of a wrench body of the powered adjustable jaw wrench of the prior art.
Figure 3A:
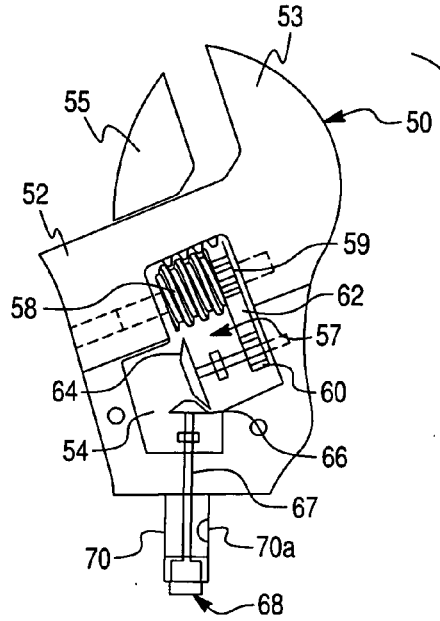
FIG. 3A is a side view of an interchangeable powered adjustable jaw wrench head unit in accordance with a first exemplary embodiment of the present invention.
Figure 3B:
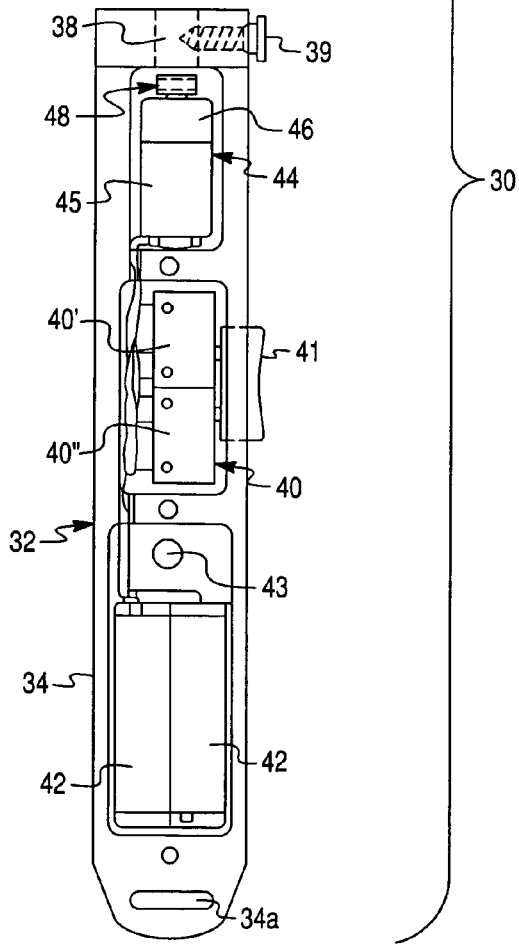
FIG. 3B is a side view of a power tool handle unit in accordance with the first exemplary embodiment of the present invention.

Referring now to FIGS. 3A and 3B, a multi-functional power tool according to a first exemplary embodiment of the present invention is illustrated generally at 30. The power tool 30 comprises a power tool handle unit 32 and a first interchangeable head unit 50 removably attachable to the tool handle unit 32.

Figure 3C:
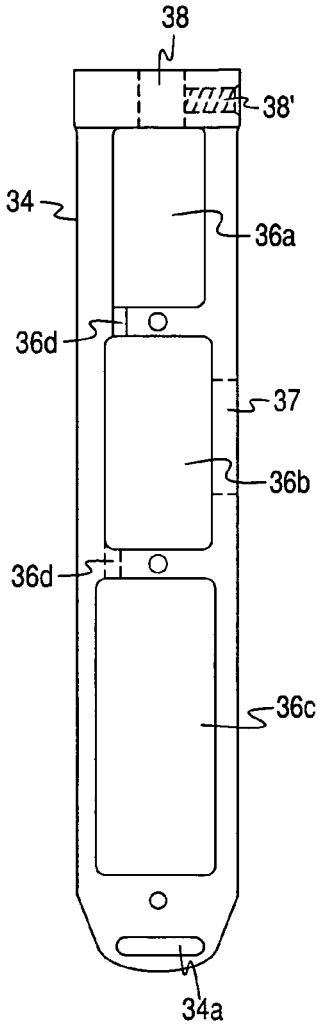
FIG. 3C is a side view of a handle body member of the power tool handle unit in accordance with the first exemplary embodiment of the present invention.
Figure 3D:
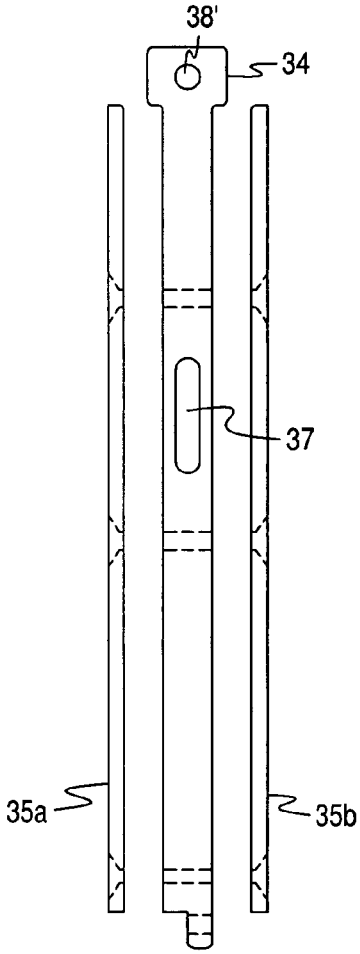
FIG. 3D is an exploded front view of the handle body member and handle covers of the power tool handle unit in accordance with the first embodiment of the present invention.

As illustrated in FIGS. 3B, 3C and 3D, preferably, the handle unit 32 includes an integral handle body member 34 and a pair of opposite handle covers 35*a* and 35*b* removably fastened to the handle body member 34, preferably by bolts or screws. The handle body member 34 in accordance with the first embodiment of the present invention, further comprises of a plurality of compartments to contain internal components of the handle unit 32: a power source compartment 36*a*, a switch compartment 36*b*, and a battery compartment 36*c*. On the distal end of the handle body member 34 a through slot 34*a* is provided for attaching a wrench tether (not shown) to, and connect to a belt loop for easy access and transporting.

Preferably, the handle body member 34, illustrated further in detail in FIG. 3B–3D, is a unitary single-piece part. It will be appreciated by those skilled in the art that the handle body member 34 may be made of any appropriate material such as metal (steel, aluminum, zinc alloy, etc.) or plastic material. The metal handle body member 34 may be manufactured, preferably, of stainless steel by forging. However, any other appropriate methods for manufacturing the handle body member 34 made of metal, such as die-casting or punching from a metal plate, are within the scope of the present invention. The plastic handle body member is manufactured, preferably, by injection molding. However, any other appropriate methods for manufacturing the handle body member 34 made of plastic material well known in the prior art, are within the scope of the present invention.

As further illustrated in FIG. 3B, the handle unit 32 further comprises a power source 44. In accordance with the first exemplary embodiment of the present invention, illustrated in FIG. 3B, the power source 44 comprises a reversible electric motor 45 and a gearbox 46 drivingly coupled to the electric motor 45. The electric motor 45 is electrically connected to a control switch assembly 40 including a switch actuator 41 controlling operation of the electric motor 45, and to at least one electric battery 42 supplying electric power to the motor 45 and the control switch assembly 40. Preferably, as shown in FIG. 3B, two batteries 42 are provided. The batteries 42 may be rechargeable. In this case, a recharge port 43 is used for recharging the batteries 42.

It will be appreciated that any appropriate type of electrical switches known in the prior art may be utilized in the present invention, such as a double pole double throw (DPDT) switch. Preferably, the control switch assembly 40 includes a pair of single pole double throw (SPDT) switches 40' and 40" and the single switch actuator 41, as shown in FIG. 3B.

The power source 44, the control switch assembly 40 and the electric batteries 42 are disposed in the corresponding compartments 36*a*, 36*b* and 36*c*, respectively, formed in the handle body member 34 of the handle unit 32, as illustrated in FIG. 3B. The handle covers 35*a* and 35*b* are adapted to seal the compartments 36*a*, 36*b* and 36*c* from the opposite sides thereof. The handle body member 34 of the handle unit 32 also has a slot 37, shown in FIGS. 3C and 3D, provided for receiving the switch actuator 41 extending therethrough as illustrated in FIG. 3B. The handle body member 34 further includes grooves or channels 36*d* interconnecting the compartments 36*a*, 36*b* and 36*c* to place necessary wires or tubing thereinto.

It will be appreciated that one of ordinary skill in the arts of the present invention can adapt the power tool according the first exemplary embodiment of the present invention to be powered by a fluid motor and fluid pressure stored in the handle by reservoirs or cartridges and carried through tubing to the motor. It can further be appreciated that fluid power can be provided to the adaptive power handles in accordance with the present invention by an externally supplied means, such as a compressor or pump, as disclosed in the U.S. Pat. No. 6,477,921 incorporated herein by reference. It will further be appreciated that one skilled in the arts of the present invention can adapt all the electrically powered handle embodiments of the present invention to accept an externally supplied battery power pack, DC plug-in adapter and/or transformer in lieu of batteries stored in the handle of the present invention.

Figure 4:
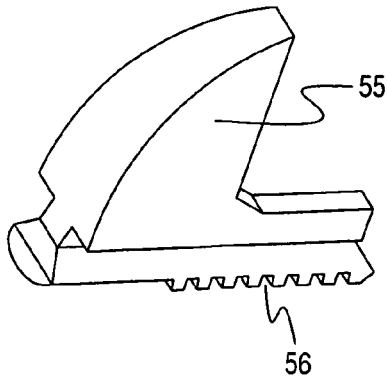
FIG. 4 is a perspective view of a movable jaw.
Figure 5A:
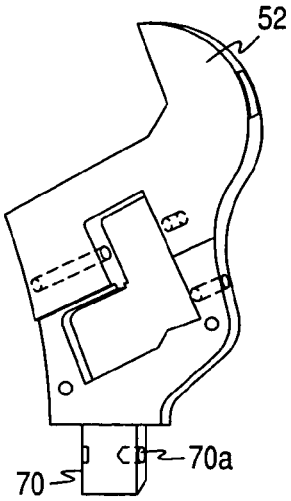
FIGS. 5A, 5B, 5C, 5D and 5E are perspective exploded views of a head body member of the wrench head unit in accordance with the first exemplary embodiment of the present invention showing of different structural arrangements of a fitting member.
Figure 5B:
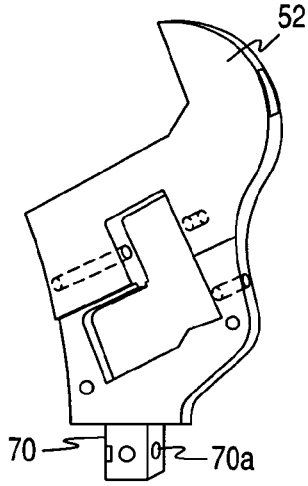
Figure 5C:
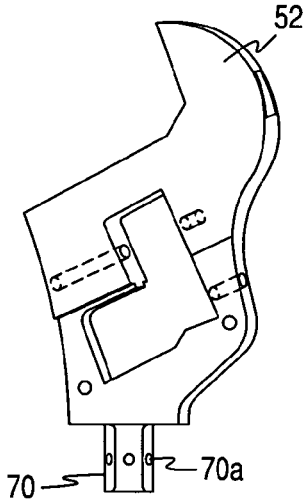
Figure 5D:
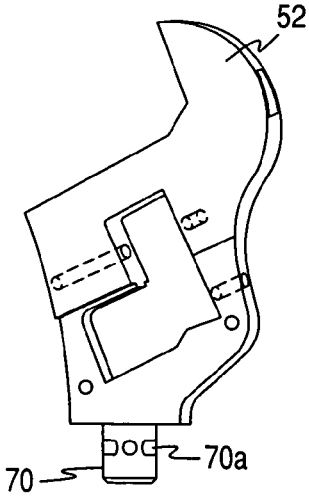
Figure 5E:
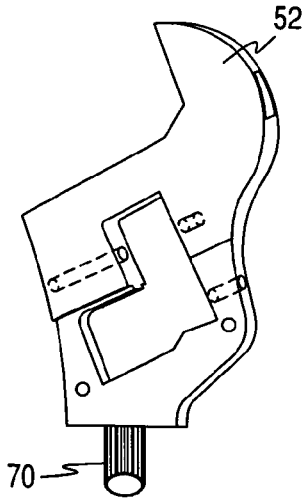

FIG. 3A illustrates the preferred embodiment of the first head unit 50 of the power tool 30 in accordance with the first exemplary embodiment of the present invention. As illustrated, the first head unit 50 is an adjustable jaw wrench head unit comprising an integral first head body member 52 defining a stationary jaw 53, and a moveable sliding jaw 55 adjustable relative to the stationary jaw 53. The movable jaw 55 is formed integral with a toothed rack 56, as shown in FIG. 4. The head body member 52 further defines a cavity 54 therein to provide a space for internal components of the adjustable jaw wrench head unit 50.

Preferably, the head body member 52, illustrated further in detail in FIG. 5A–5E, is a unitary single-piece part. It will be appreciated by those skilled in the art that the head body member 52 may be made of any appropriate material such as metal (steel, aluminum, etc.) or plastic material. The metal head body member 52 may be manufactured, preferably, of stainless steel by forging. However, any other appropriate methods for manufacturing the head body member 52 made of metal, such as die-casting or punching from a metal plate, are within the scope of the present invention. The plastic head body member is manufactured, preferably, by injection molding. However, any other appropriate methods for manufacturing the head body member 52 made of plastic material well known in the prior art, are within the scope of the present invention.

It will be appreciated that the adjustable jaw wrench head unit 50 may be manufactured in various size proportions to accommodate a large range of fasteners and fittings. Therefore, the multi-functional power tool of the present invention may be provided with a plurality of the adjustable jaw wrench head units 50 of various size proportions.

The adjustable jaw wrench head unit 50 according to the present invention further includes a drive mechanism 57 mounted to the head body member 52 within the cavity 54 formed therein. The drive mechanism 57 according to the first exemplary embodiment of the adjustable jaw wrench head unit 50, comprises a worm gear 58 and a first toothed sprocket 59 both rotatably mounted to the head body member 52 of the wrench head unit 50 coaxially with respect to each other. The worm gear 58 is operably connected to the toothed rack 56 of the movable jaw 55 so that the rotatable movement of the worm gear 58 is transformed into the linear movement of the movable jaw 55 toward and away from the stationary jaw 53.

The drive mechanism 57 further comprises a self-contained transmission including first and second pulleys 59 and 60, respectively, connected by an endless toothed drive belt 62, and offset bevel gears 64 and 66 to transfer rotary movement to the worm gear 58. The bevel gear 66 is drivingly coupled to a power take-off shaft 67. As illustrated in FIG. 3A, the first pulley 59 is drivingly coupled to the worm gear 58, while the second pulley 60 is drivingly coupled to the bevel gear 64. Alternatively, the drive mechanism 57 may include an endless chain instead of drive belt 62 for rotating the worm gear 58. It will be appreciated by those skilled in the art that any other type of an endless torque-transmitting element known in the prior art is within the scope of the present invention.

The handle unit 32 also includes a handle coupling device 48 operatively coupled to an output shaft (not shown) of the gearbox 46, while the first head unit 50 includes a head coupling device 68 operatively coupled to the power take-off shaft 67 at a distal end thereof. The head coupling device 68 is complementary to the handle coupling device 48 and is provided to drivingly couple the power source 44 to the power take-off shaft 67 of the drive mechanism 57.

Furthermore, the handle unit 32 has a fitting portion, while the first head unit 50 includes a fitting member provided to matingly engage the fitting portion of the handle unit 32 so as to removably secure the first head unit 50 to the handle unit 32. Preferably, the fitting member of the first head unit 50 is in the form of a hollow elongated mating post 70 extending from the head body member 52, while the fitting portion of the handle unit 32 is in the form of a mating post cavity 38 in the handle body member 34 provided to matingly receive the elongated post 70 of the fitting member of the first head unit 50 therein. Preferably, the elongated post 70 of the fitting member is formed integrally with the head body member 52 as a homogenous, unitary single-piece head part.

The fitting member of the first head unit 50 further includes at least one detent 70*a* preferably provided on the elongated post 70. On the other hand, the fitting portion of the handle unit 32 also includes at least one retractable spring plunger 39 disposed in a through opening 38' in the handle body member 34 and adapted to engage the complementary detent 70*a*. Accordingly, when the elongated post 70 of the first head unit 50 is inserted into the mating post cavity 38 in the handle body member 34, a tip of the retractable spring plunger 39 engages the complementary detent 70*a*, thus securing (or locking) the first head unit 50 to the handle unit 32.

Those of ordinary skill in the art would appreciate that the elongated post 70 of the fitting member of the first head unit 50 may be of any appropriate shape (or cross-section) including but not limited to rectangular (shown in FIG. 5A), square (shown in FIG. 5B), hexagonal (shown in FIG. 5C), circular (shown in FIG. 5D), serrated or splined (shown in FIG. 5E), etc. Accordingly, the mating post cavity 38 in the handle body member 34 has a shape complimentary to the shape of the elongated post 70 of the first head unit 50.

Further in accordance with the present invention, there are different types of spring plungers, ball plungers and detents, as well as fasteners utilized to connect and secure the interchangeable head units to the tool handle unit 32. Some of the preferred modes to carry out the invention include the retractable spring plunger 39 with a round knurled knob shown in FIG. 3B. Alternatively, a non-retractable ball plunger, a retractable spring plunger with a knurled knob and a lock-out feature, a retractable spring plunger with a pull-ring instead of a knurled knob or a set screw may be used in lieu of the spring plunger. Further alternatively, FIG. 6 shows a spring-loaded lever operated detent 39, attached to the tool handle unit 32 and bisecting post cavity 38. Moreover, depending on the design of the tool handle unit 32, one or more spring plungers can be utilized, or one or more fasteners can be utilized and/or a combination of both spring plungers and fasteners can be used to secure interchangeable head units in accordance with the present invention. Cam activated locks and ratchet pawls (not shown) are also within the scope of the present invention as alternate means to secure interchangeable head units to the handle unit.

One of ordinary skill in the art would appreciate the present invention is adapted to select and rotate the position of the wrench head unit 50 relative to the switch actuator 41 of the tool handle unit 32. The rotating wrench head feature has its major advantages when the angle of the work related to the wrench head unit is most difficult to achieve, and when the user encounters a tight spot and hand access is limited. Rotation of the head unit 50 in relation to the handle unit 32 and switch actuator 41 facilitates a correct and true right hand or left hand use of the adjustable wrench head unit 50. The detents 70*a* incrementally spaced around the perimeter of the bottom post 70 facilitate indexing and receive a pin, ball, ratchet or fastener to lock the desired position of the rotating wrench head unit 50.

It will be appreciated that when the first head unit 50 is properly secured to the handle unit 32, i.e. when the elongated post 70 of the head body member 52 is fully received in the mating post cavity 38 in the handle body member 34, the head coupling device 68 appropriately engages the handle coupling device 48, thus drivingly coupling the power source 44 to the power take-off shaft 67 of the drive mechanism 57. In other words, when the first head unit 50 is united with and secured to the handle unit 32, head coupling device 68 and the handle coupling device 48 also connect and engage each other to transfer rotatable movement from the power source 44 to the worm gear 58 of the head unit 50.

The head coupling device 68 and the handle coupling device 48 are a set of mechanical coupling devices that engage with one another to transfer rotary power from the power source 44 to the drive mechanism 57 of the wrench head unit 50. Those of ordinary skill in the art will appreciate that the handle coupling device 48 and the complementary head coupling device 68 may be of any appropriate design.

In accordance with a first exemplary embodiment, as illustrated in FIGS. 7A–7C, the handle coupling device 48 is provided with a drive cam 49, while the complementary head coupling device 68 is provided with a driven cam 69 adapted to positively engage the drive cam 49 of the handle coupling device 48 to transfer drive torque from the power source 44 to the drive mechanism 57 of the wrench head unit 50.

In accordance with a second exemplary embodiment, as illustrated in FIGS. 8A–8C, the handle coupling device $\mathbf{48}_1$ is provided with a magnet $\mathbf{49}_1$, while the complementary head coupling device $\mathbf{68}_1$ is provided with a like magnet $\mathbf{69}_1$ of opposite polarity adapted to firmly engage the magnet $\mathbf{49}_1$ with the magnetic force enough to transfer drive torque from the power source 44 to the drive mechanism 57 of the wrench head unit 50. Alternately, one magnet can be utilized in the handle coupling device $\mathbf{48}_1$ and a metal plug integrally in the head coupling device $\mathbf{68}_1$, or vice-versa.

In accordance with a third exemplary embodiment, as illustrated in FIGS. 9A–9C, the handle coupling device $\mathbf{48}_2$ is provided with a gear or ratchet teeth $\mathbf{49}_2$, while the complementary head coupling device $\mathbf{68}_2$ is provided with a matching gear or ratchet teeth $\mathbf{69}_2$ adapted to positively engage the ratchet teeth $\mathbf{49}_2$ of the handle coupling device 48 to transfer drive torque from the power source 44 to the drive mechanism 57 of the wrench head unit 50.

In accordance with a fourth exemplary embodiment, as illustrated in FIGS. 10A–10C, a compressible coil spring $\mathbf{49}_3$ is placed between the handle coupling device $\mathbf{48}_3$ and the complementary head coupling device $68_3$ to transfer drive torque from the power source 44 to the drive mechanism 57 of the wrench head unit 50.

In accordance with a fifth exemplary embodiment, as illustrated in FIGS. 11A–11C, the handle coupling device $48_4$ is provided with a drive tang $49_4$, while the complementary head coupling device $68_4$ is provided with a matching slot $69_4$ adapted to positively engage the drive tang $49_4$ of the handle coupling device $48_4$ to transfer drive torque from the power source 44 to the drive mechanism 57 of the wrench head unit 50, or vice-versa.

As illustrated in FIGS. 12A and 12B, the adjustable jaw wrench head unit 50 may further include a pair of opposite cover members 72*a* and 72*b* provided to cover the cavity 54 in the head body member 52 as shown in FIG. 12B. The head body member 52 includes holes 74, while the cover members 72*a* and 72*b* have holes 75*a* and 75*b*, respectively. The cover members 72*a* and 72*b* are fastened to the head body member 52 by means of the threaded fasteners 76 extending through the holes 75*a* and 75*b* in the cover members 72*a* and 72*b* and the holes 74 in the head body member 52. Each of the cover members 72*a* and 72*b* has an integral extended tab 73*a* and 73*b*, respectively, utilized to protect the pulleys 59 and 60, and the drive belt 62 as best shown in FIG. 12B.

Figure 12C:
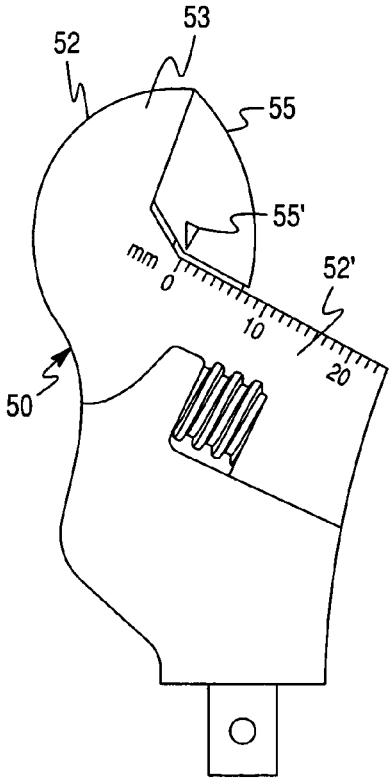
FIG. 12C is a side view of the interchangeable powered adjustable jaw wrench head unit provided with a metric scale device.
Figure 12D:
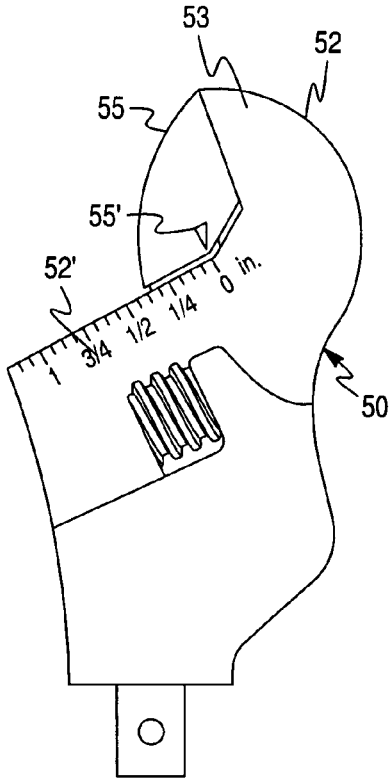
FIG. 12D is a side view of the interchangeable powered adjustable jaw wrench head unit provided with a British scale device.

As further illustrated in FIGS. 12C and 12D, the adjustable jaw wrench head unit 50 may further include a scale device provided for measuring a wrench jaw opening, i.e. a distance between the stationary jaw 53 and the moveable jaw 55. The scale device includes a numeric scale provided on the head body member 52 and an indicator arrow (or marker) 55' marked on the moveable jaw 55 opposite to the numeric scale. In accordance with the embodiment shown in FIG. 12C, the numeric scale is a metric scale 52', while in accordance with the embodiment shown in FIG. 12D, the numeric scale is a British scale 52". Preferably, the indicator arrow 55' and the scale device are provided on both sides of the moveable jaw 55 and the head body member 52, respectively.

Figure 13A:
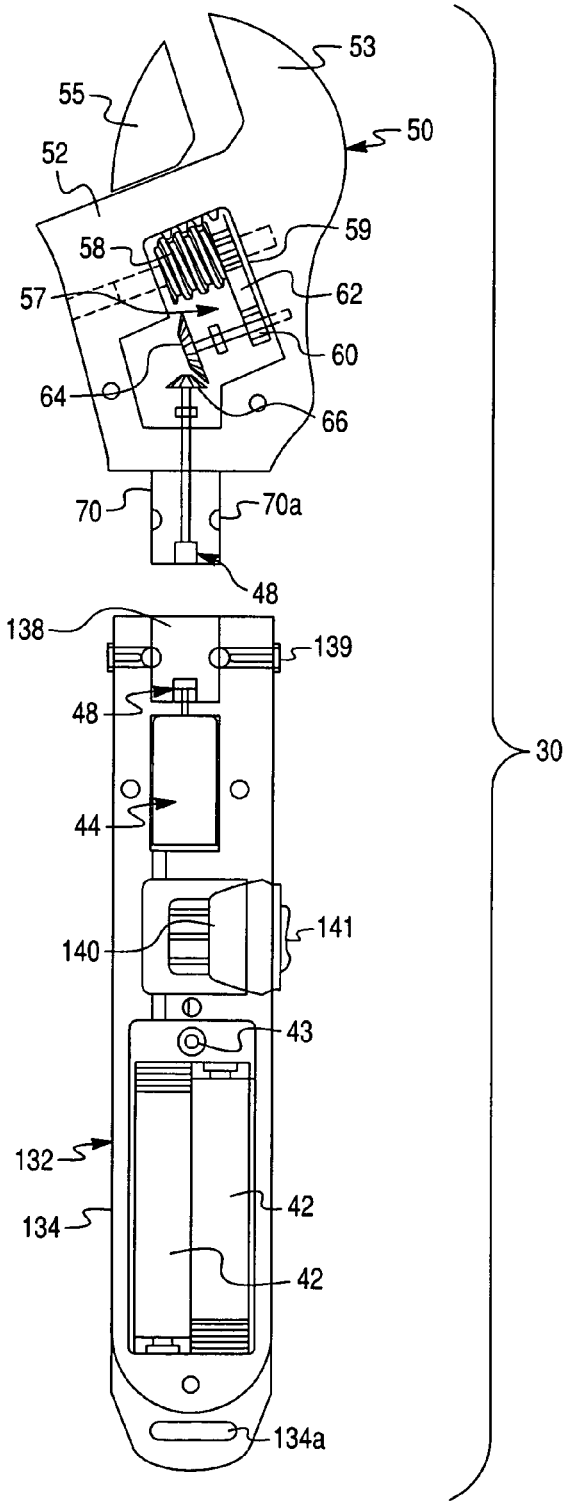
FIG. 13A is a side view of a power tool in accordance with the first exemplary embodiment of the present invention including an alternative embodiment of the power tool handle unit.
Figure 13B:
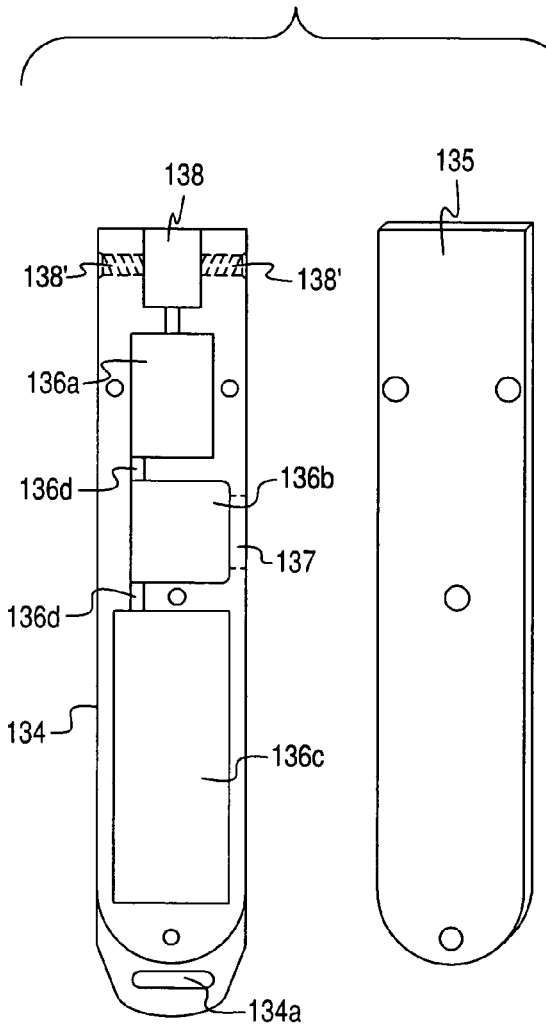
FIG. 13B is a side view of the alternative embodiment of the handle body member of the power tool handle unit.
Figure 13C:
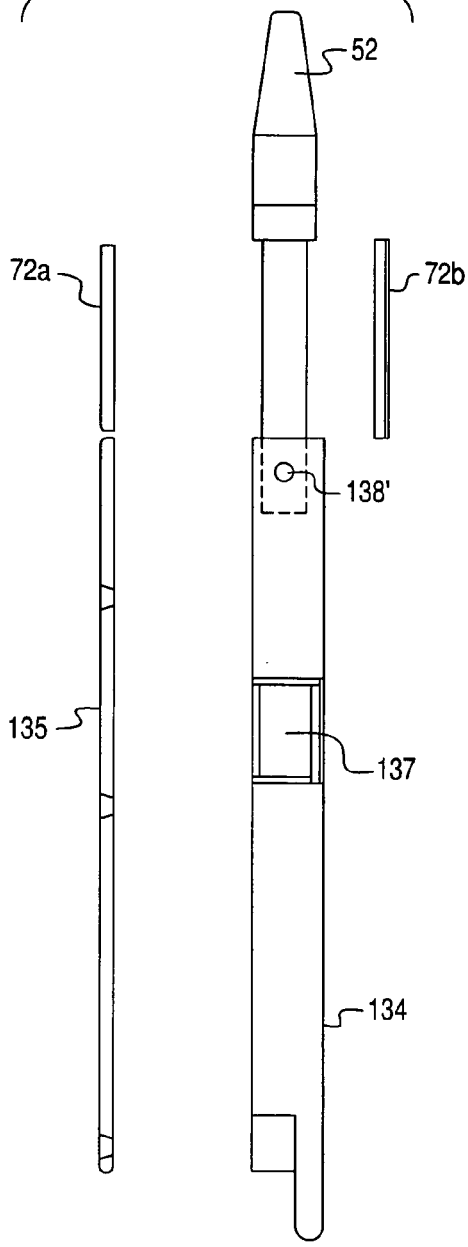
FIG. 13C is an exploded front view of the alternative embodiment of the handle body member and a handle cover.

FIGS. 13A–13C illustrate an alternative embodiment of the handle unit, generally labeled with the reference character 132, of a power tool 30 according to the first exemplary embodiment of the present invention. Components, which are unchanged from the preferred exemplary embodiment of the handle unit 32 depicted in FIGS. 3A–12B are labeled with the same reference characters. Components, which function in the same way as in the preferred embodiment of the present invention depicted in FIGS. 3A–12B are designated by the same reference numerals to which 100 has been added, sometimes without being described in detail since similarities between the corresponding parts in the two embodiments will be readily perceived by the reader.

In this embodiment, the power tool comprises a power tool handle unit 132 and the first interchangeable head unit 50 removably attachable to the tool handle unit 132. The handle unit 132 comprises a handle body member 134 and a handle cover 135 removably fastened to the handle body member 134 by any appropriate fashion known in the art, such as screws. Preferably, the handle body member 134 is formed as a unitary single-piece part. It will be appreciated by those skilled in the art that the handle body member 134 may be made of any appropriate material such as metal (steel, aluminum, etc.) or plastic material. The metal handle body member 134 may be manufactured, preferably, of stainless steel by forging. However, any other appropriate methods for manufacturing the handle body member 134 made of metal, such as die-casting or punching from a metal plate, are within the scope of the present invention. The plastic handle body member is manufactured, preferably, by injection molding. However, any other appropriate methods for manufacturing the handle body member made of plastic material well known in the prior art, are within the scope of the present invention.

The handle body member 134 in accordance with the second embodiment of the present invention, further comprises of a plurality of cavities formed therein to contain internal components of the handle unit 132: a power source cavities 136*a*, a switch cavities 136*b*, and a battery cavities 136*c*, shown in FIG. 13B. On the distal end of the handle body member 134*a* through slot 134*a* is provided for attaching a wrench tether (not shown) to, and connect to a belt loop for easy access and transporting.

As further illustrated in FIG. 13A, the handle unit 132 further comprises a power source 44, such as a reversible electric motor, and a handle coupling device 48 operatively coupled to an output shaft of the power source 44. The power source 44 is electrically connected to a control switch assembly 140 including a switch actuator 141 controlling operation of the electric motor of the power source 44, and to at least one electric battery 42 supplying electric power to the motor and the control switch assembly 140. Preferably, as shown in FIG. 13A, two batteries 42 are provided. The batteries 42 may be rechargeable. In this case, a recharge port 43 is used for recharging the batteries 42. Preferably, the control switch assembly 140 utilized in this embodiment of the present invention is a double pole double throw (DPDT) switch.

The power source 44, the control switch assembly 140 and the electric batteries 42 are disposed in the corresponding cavities 136*a*, 136*b* and 136*c*, respectively, formed in the handle body member 134 of the handle unit 132, as illustrated in FIG. 13A. The handle cover 135 is adapted to seal the cavities 136*a*, 136*b* and 136*c*. The handle body member 134 of the handle unit 132 also has a slot 137, shown in FIGS. 13B and 13C, provided for receiving the switch actuator 141 extending therethrough as illustrated in FIG. 13A. The handle body member 134 further includes grooves or channels 136*d* interconnecting the cavities 136*a*, 136*b* and 136*c* to place necessary wires or tubing thereinto.

The handle body member 134 is also provided with a post cavity 138 therein to matingly receive the elongated post 70 of the first head unit 50 therein. The handle unit 132 also includes two non-retractable ball plungers 139 disposed in through openings 138' in the handle body member 134 and adapted to engage the complementary detents 70*a* in the elongated post 70 of the first head unit 50. Accordingly, when the elongated post 70 of the first head unit 50 is inserted into the mating post cavity 138 in the handle body member 134, tips of the ball plungers 139 engage the complementary detents 70*a*, thus securing (or locking) the first head unit 50 to the handle unit 132.

Figure 14A:
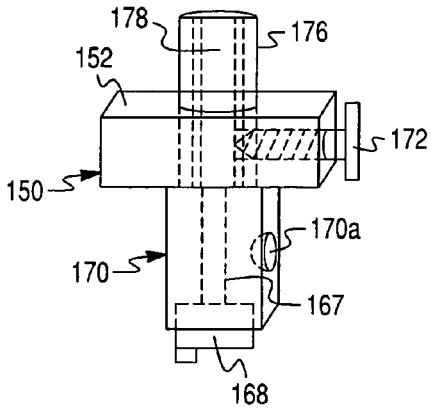
FIG. 14A is a side view of a second head unit in accordance with the first exemplary embodiment of the present invention.
Figure 14B:
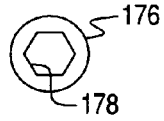
FIG. 14B is a front view of the second head unit in accordance with the first exemplary embodiment of the present invention.

FIG. 14A–14B illustrate a second interchangeable head unit 150 in accordance with the first exemplary embodiment of the present invention. Components, which are unchanged from the previous exemplary embodiments of the present invention depicted in FIGS. 3A–13C are labeled with the same reference characters. Components, which function in the same way as in the first exemplary embodiment of the present invention depicted in FIG. 3A are designated by the same reference numerals to which 100 has been added, sometimes without being described in detail since similarities between the corresponding parts in the two embodiments will be readily perceived by the reader.

The second interchangeable head unit 150 is in the form of a interchangeable, powered tool head unit comprising of a body member 152, a mechanical coupling device 168 provided at a distal end of a power take off shaft 167 disposed within the body member 152, a tool bit barrel 176 and a tool bit holder spindle 178.

The second head unit 150 further includes a fitting member provided to matingly engage the fitting portion of the handle unit 32 (or, alternatively, the handle unit 132 of FIGS. 13A–13C) so as to removably secure the second head unit 150 to the handle unit 32 (or the handle unit 132). Preferably, the fitting member of the second head unit 150 is in the form of a hollow elongated post 170 extending from the head body member 152, and adapted to be received in the mating post cavity 38 in the handle body member 34. Preferably, the elongated post 170 of the coupling member is formed integrally with the second head body member 152 as a homogenous, unitary single-piece head part.

The fitting member of the second head unit 150 also includes at least one detent 170*a* provided on the elongated post 170. Accordingly, when the elongated post 170 of the second head unit 150 is inserted into the mating post cavity 38 in the handle body member 34, a tip of the retractable spring plunger 39 engages the complementary detent 170*a*, thus removably securing (or locking) the second head unit 150 to the handle unit 32.

Rotary power provided from the power tool handle 32 is transferred to the second interchangeable powered tool head unit 150 via the power take off shaft 167 and the coupling device 168, which is integrally connected to the tool bit holder spindle 178.

Figure 15A:
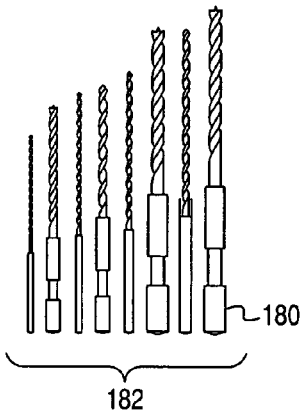
FIGS. 15A, 15B, 15C and 15D are views of accessory tools utilized in conjunction with the second interchangeable powered tool head unit in accordance with the first exemplary embodiment of the present invention.
Figure 15B:
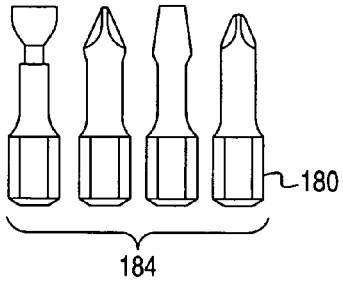
Figure 15D:
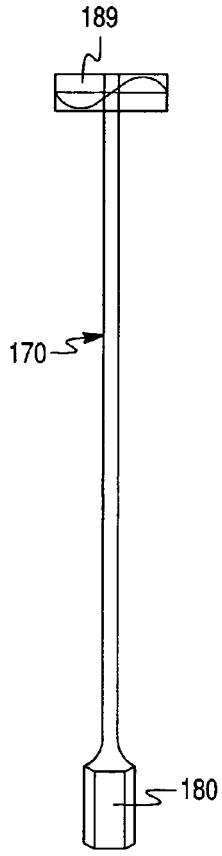
Figure 15C:
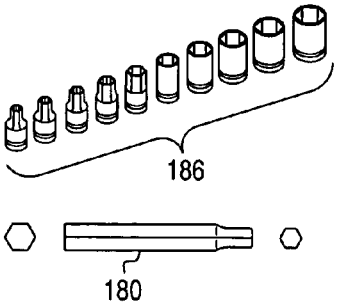

The tool bit barrel 176 is a support and acts as a bearing for the tool bit holder spindle 178. Preferably, the tool bit holder spindle 178 is in the form of a female hexagonal shaped receiving socket, as illustrated in FIG. 14B, able to accept various tools having a common male hexagonal shaft member 180 as shown in FIGS. 15A, 15B, 15C and FIG. 15D and are all compatible with the second interchangeable powered tool head unit 150, of the first embodiment of the present invention. FIG. 15A illustrates drill bits 182 having the hexagonal shaft member 180. FIG. 15B shows screw driver bits 184 having the hexagonal shaft member 180. FIG. 15C illustrates hexagonal wrench sockets 186 each having a hexagonal extension shaft 180. FIG. 15D shows a mixer shaft 188, having a turbine 189 located at the top, and the hexagonal shaft member 180 at the base. A first spring plunger with a lock-out feature 172 located on the second head body member 152 is used to lock the tool bit holder spindle when manual turning of the tool is desired.

FIGS. 16A–16C illustrate a power tool, generally labeled with the reference character 230, according to a second exemplary embodiment of the present invention. Components, which are unchanged from the first exemplary embodiment of the present invention depicted in FIGS. 3A–12B are labeled with the same reference characters. Components, which function in the same way as in the first exemplary embodiment of the present invention depicted in FIGS. 3A–12B are designated by the same reference numerals to which 200 has been added, sometimes without being described in detail since similarities between the corresponding parts in the two embodiments will be readily perceived by the reader.

The multi-functional power tool 230 comprises a power tool handle unit 232 and a first interchangeable head unit 250 removably attachable to the tool handle unit 232.

As illustrated in FIGS. 16A, 16B and 16C, the handle unit 232 includes an integral handle body member 234 and a pair of opposite handle covers 235*a* and 235*b* removably fastened to the handle body member 234, preferably by bolts or screws. The handle body member 234 in accordance with the second embodiment of the present invention, further comprises of a plurality of compartments to contain internal components of the handle unit 232: a connector compartment 236*a*, a switch compartment 236*b*, and a battery compartment 236*c*. On the distal end of the handle body member 234 a through slot 234*a* is provided for attaching a wrench tether (not shown) to, and connect to a belt loop for easy access and transporting.

As further illustrated in FIG. 16B, the handle unit 232 further comprises a control switch assembly 40 including a switch actuator 41, at least one electric battery 42 connected to the control switch assembly 40, and an electric handle connector 248 electrically coupled to the batteries 42 through the control switch assembly 40. Preferably, as shown in FIG. 16B, two batteries 42 are provided. The batteries 42 may be rechargeable. In this case, a recharge port 43 is used for recharging the batteries 42. Further preferably, the electric handle connector 248 includes a pair of male conductive pins 249.

Preferably, the control switch assembly 40 includes a pair of single pole double throw (SPDT) switches 40' and 40" and the single switch actuator 41, as shown in FIG. 16B. It will be appreciated that any appropriate type of electrical switches known in the prior art may be utilized in the present invention, such as a double pole double throw (DPDT) switch.

The electric handle connector 248, the control switch assembly 40 and the electric batteries 42 are disposed in the corresponding compartments 236*a*, 236*b* and 236*c*, respectively, formed in the handle body member 234 of the handle unit 232, as illustrated in FIG. 16B. The handle covers 235*a* and 235*b* are adapted to seal the compartments 236*a*, 236*b* and 236*c* from the opposite sides thereof. The handle body member 234 of the handle unit 232 also has a slot 237, shown in FIG. 16C, provided for receiving the switch actuator 41 extending therethrough as illustrated in FIG. 16B. The handle body member 234 further includes grooves or channels interconnecting the compartments 236*a*, 236*b* and 236*c* to place necessary wires or tubing thereinto.

FIG. 16A illustrates the preferred embodiment of the first head unit 250 of the power tool 230 in accordance with the second exemplary embodiment of the present invention. As illustrated, the first head unit 250 is an adjustable jaw wrench head unit comprising an integral head body member 52 defining a stationary jaw 53, and a moveable sliding jaw 55 adjustable relative to the stationary jaw 53. The movable jaw 55 is formed integral with a toothed rack 56, as shown in FIG. 4. The head body member 52 further defines a cavity 54 therein to provide a space for internal components of the adjustable jaw wrench head unit 250.

Preferably, the head body member 52, illustrated further in detail in FIG. 16A, is a unitary single-piece part. It will be appreciated by those skilled in the art that the head body member 52 may be made of any appropriate material such as metal (steel, aluminum, etc.) or plastic material. The metal head body member 52 may be manufactured, preferably, of stainless steel by forging. However, any other appropriate methods for manufacturing the head body member 52 made of metal, such as die-casting or punching from a metal plate, are within the scope of the present invention. The plastic head body member is manufactured, preferably, by injection molding. However, any other appropriate methods for manufacturing the head body member 52 made of plastic material well known in the prior art, are within the scope of the present invention.

The adjustable jaw wrench head unit 250 according to the present invention further includes a drive mechanism 257 mounted to the head body member 52 within the cavity 54 formed therein. The drive mechanism 257 according to the second exemplary embodiment of the present invention, comprises a worm gear 58 and a first toothed sprocket 59 both rotatably mounted to the head body member 52 of the wrench head unit 250 coaxially with respect to each other. The worm gear 58 is operably connected to the toothed rack 56 of the movable jaw 55 so that the rotatable movement of the worm gear 58 is transformed into the linear movement of the movable jaw 55 toward and away from the stationary jaw 53.

The drive mechanism 257 further comprises a self-contained transmission including a second toothed sprocket 60 connected to the first toothed sprocket 59 by an endless toothed drive belt 62, to transfer rotary movement to the worm gear 58. The wrench head unit 250 further includes a power source 44. The power source 44 comprises a reversible electric motor 45 and a gearbox 46 drivingly coupled to the electric motor 45. As illustrated in FIG. 16A, the first toothed sprocket 59 is drivingly coupled to the worm gear 58, while the second toothed sprocket 60 is drivingly coupled to the power source 44. Thus, the power source 44 is employed for rotating the worm gear 58 through the drive mechanism 257.

Furthermore, the handle unit 232 has a fitting portion, while the first head unit 250 includes a fitting member provided to matingly engage the fitting portion of the handle unit 232 so as to removably secure the first head unit 250 to the handle unit 232. Preferably, the fitting member of the first head unit 250 is in the form of a hollow elongated post 70 extending from the head body member 52, while the fitting portion of the handle unit 232 is in the form of a mating post cavity 238 in the handle body member 234 provided to matingly receive the elongated post 70 of the coupling member of the first head unit 250 therein. Preferably, the elongated post 70 of the coupling member is formed integrally with the head body member 52 as a homogenous, unitary single-piece head part. The fitting portion of the handle unit 232 also includes at least one retractable spring plunger 239 disposed in a through opening 238' in the handle body member 234 and adapted to engage the complementary detent 70*a* of the elongated post 70.

The first head unit 250 includes an electric head connector 268 electrically coupled to the electric motor 45 of the power source 44. The electric head connector 268 is complementary to the electric handle connector 248 and is provided to electrically connect the control switch assembly 40 to the power source 44 for selectively supplying electrical current form the batteries 42 to the electric motor 45. Preferably, as illustrated in FIG. 16A, the electric head connector 268 includes a pair of female receptacle pins 269 adapted to receive the complementary male pins 249.

Figure 16D:
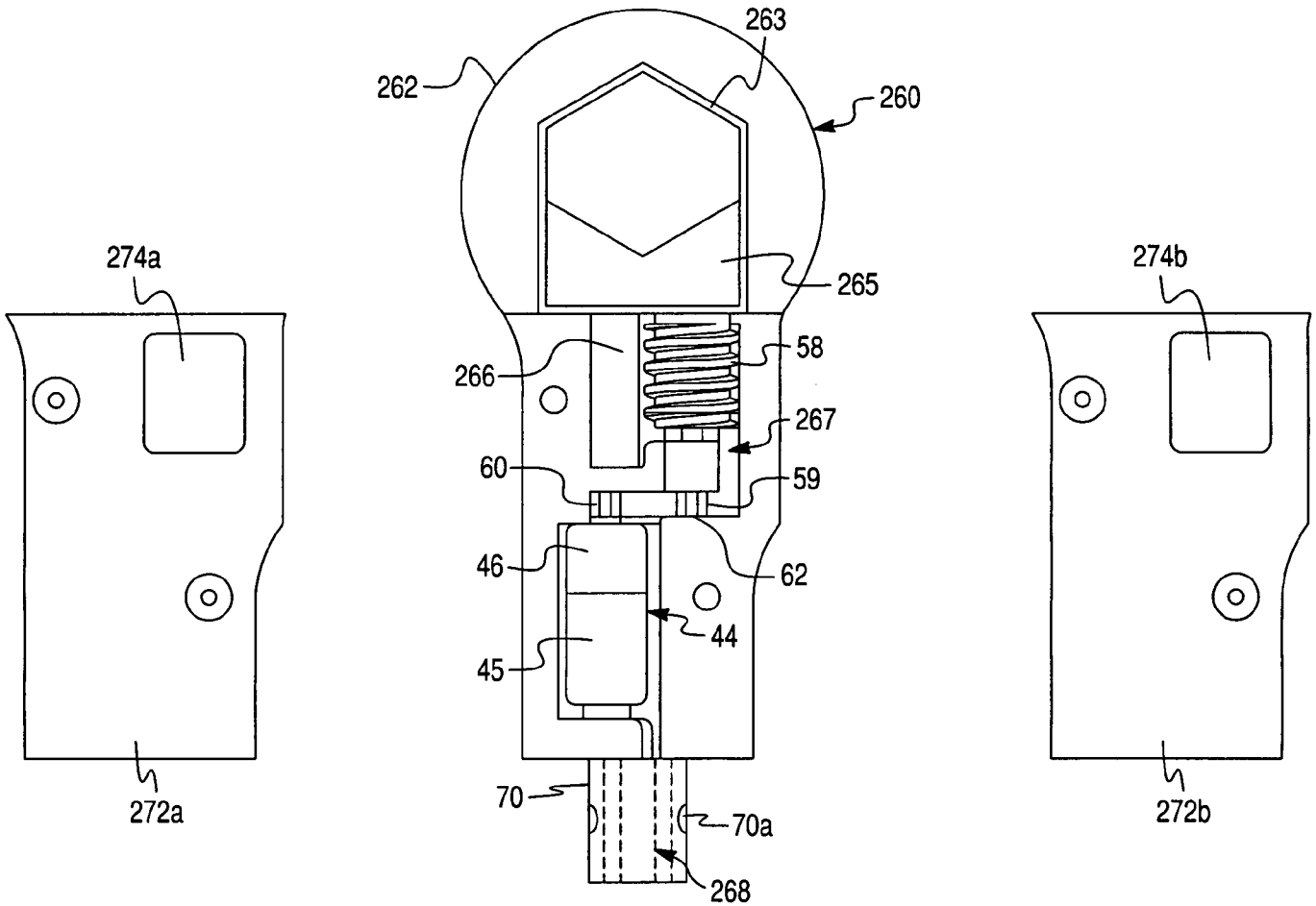
FIG. 16D is a side view of an second interchangeable powered adjustable jaw wrench head unit in accordance with the second exemplary embodiment of the present invention.

As further illustrated in FIG. 16D, the multi-functional power tool 230 further comprises a second interchangeable head unit 260 removably attachable to the tool handle unit 232.

As illustrated, the first head unit 260 is a powered adjustable jaw closed wrench head unit comprising an integral head body member 262 defining a stationary jaw 263, and a moveable sliding jaw 265 adjustable relative to the stationary jaw 263. The movable jaw 265 is formed integral with a toothed rack 266, as shown in FIG. 16D.

Preferably, the head body member 262 is a unitary single-piece part. The adjustable jaw wrench head unit 260 further includes a drive mechanism 267 mounted to the head body member 262. The drive mechanism 267 comprises a worm gear 58 and a first toothed sprocket 59 both rotatably mounted to the head body member 262 of the second head unit 260 coaxially with respect to each other. The worm gear 58 is operably connected to the toothed rack 266 of the movable jaw 265 so that the rotatable movement of the worm gear 58 is transformed into the linear movement of the movable jaw 265 toward and away from the stationary jaw 263. Two cover members 272*a* and 272*b* fastened to the head body member 262 are used to contain all the components in the second wrench head unit 260. The cover members 272*a* and 272*b* are provided with worm gear access windows 274*a* and 274*b*.

The drive mechanism 267 further comprises a self-contained transmission including first and second pulleys 59 and 60, respectively, connected by an endless toothed drive belt 62, to transfer rotary movement to the worm gear 58. The second wrench head unit 260 further includes a power source 44. The power source 44 comprises a reversible electric motor 45 and a gearbox 46 drivingly coupled to the electric motor 45. As illustrated in FIG. 16D, the first pulley 59 is drivingly coupled to the worm gear 58, while the second pulley 60 is drivingly coupled to the power source 44. Thus, the power source 44 is employed for rotating the worm gear 58 through the drive mechanism 267.

Furthermore, the second head unit 260 includes a fitting member provided to matingly engage the fitting portion of the handle unit 232 so as to removably secure the second head unit 260 to the handle unit 232. Preferably, the fitting member of the second head unit 260 is substantially similar to the fitting member of the first head unit 250, and is in the form of the hollow elongated post 70 extending from the head body member 262 adapted to engage the mating post cavity 238 in the handle body member 234. Preferably, the elongated post 70 of the coupling member is formed integrally with the head body member 262 as a homogenous, unitary single-piece head part.

The second head unit 260 further includes the electric head connector 268 substantially similar to the electric head connector of the first head unit 250 and electrically coupled to the electric motor 45 of the power source 44. The electric head connector 268 is complementary to the electric handle connector 248 of the tool handle unit 232 and is provided to electrically connect the control switch assembly 40 to the power source 44 for selectively supplying electrical current form the batteries 42 to the electric motor 45.

Figure 16E:
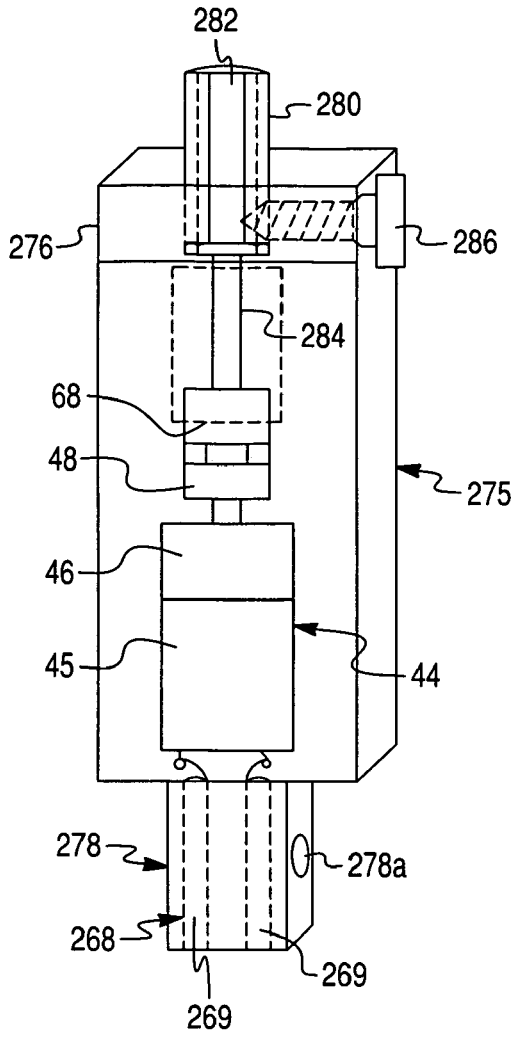
FIG. 16E is a side view of an third head unit in accordance with the second exemplary embodiment of the present invention.

FIG. 16E illustrates a third interchangeable head unit 275 removably attachable to the tool handle unit 232 in accordance with the second exemplary embodiment of the present invention. Components, which are unchanged from the previous exemplary embodiments of the present invention depicted in FIGS. 16A and 16D are labeled with the same reference characters without being described in detail since similarities between the corresponding parts in the two embodiments will be readily perceived by the reader.

The third interchangeable head unit 275 is in the form of a interchangeable powered tool head unit removably attachable to the tool handle unit 232 and comprising of a hollow body member 276 having a bottom post 278 with an electric head connector 268 and at least one detent 278*a*, and a first spring plunger with a lock-out feature 286. The bottom post 278 is adapted to be received in the mating post cavity 238 in the handle body member 234 of the power tool handle unit 232. Preferably, the bottom post 278 is formed integrally with the body member 276 as a homogenous, unitary single-piece head part. Accordingly, when the bottom post 278 of the third head unit 275 is inserted into the mating post cavity 238 in the handle body member 234, a tip of the retractable spring plunger 239 engages the complementary detent 278*a*, thus removably securing (or locking) the third head unit 275 to the handle unit 232.

The third head unit 275 further includes a power source 44 comprising a reversible electric motor 45 and a gearbox 46 drivingly coupled to the electric motor 45, a gearbox coupling 48, a power take off shaft 284 and a coupling 68, a tool bit barrel 280 and a tool bit holder spindle 282. Thus, the power source 44 is employed for rotating the spindle 282 through the couplings 48 and 68.

The electric head connector 268 of the third head unit 275 is substantially similar to the electric head connector of the first head unit 250 and electrically coupled to the electric motor 45 of the power source 44. The electric head connector 268 is complementary to the electric handle connector 248 of the tool handle unit 232 and is provided to electrically connect the control switch assembly 40 to the power source 44 for selectively supplying electrical current form the batteries 42 to the electric motor 45. More specifically, the electric head connector 268 includes a pair of female receptacle pins 269 adapted to receive the complementary male pins 249.

Tool bit spindle 282 is integrally formed with the power take-off shaft coupling device 68, and rotates in tool bit barrel 280. The tool bit barrel 280 is a support and acts as a bearing for the tool bit holder spindle 282. Preferably, the tool bit holder spindle 282 is in the form of a female hexagonal shaped receiving socket able to accept various tools having a common male hexagonal shaft member 180 as shown in FIGS. 15A, 15B, 15C and FIG. 15D and are all compatible with the third interchangeable powered tool head unit 275, of the second embodiment of the present invention. The first spring plunger with a lock-out feature 286 is located on the interchangeable powered tool head unit 275 and is used to lock the tool bit holder spindle 282 when manual turning of the tool is desired.

Figure 16F:
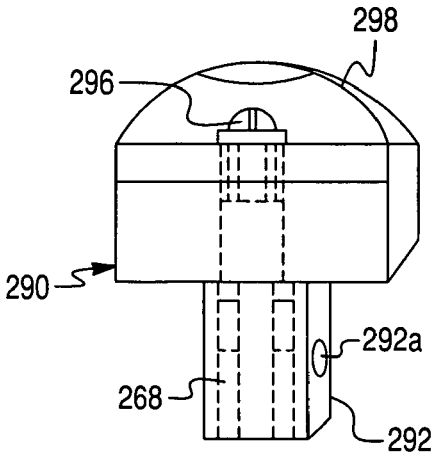
FIG. 16F is a side view of an fourth head unit in accordance with the second exemplary embodiment of the present invention.

As further illustrated in FIG. 16F, the multi-functional power tool 230 further comprises a fourth interchangeable head unit 290 removably attachable to the tool handle unit 232.

As illustrated, the fourth head unit 290 is an interchangeable powered illumination head unit comprising of a bottom post 292 with an electric head connector 268, at least one detent 292*a*, an illumination device, preferably, in the form of an LED 296, and a magnifying cover 298.

Electrical power provided from the batteries 42 of the tool handle unit 232 is transferred through the electric connectors 248 and 268 to the illumination device 296. Magnifying cover 298 enhances brilliance and light coverage. It will be appreciated that the illumination device 296 can be of any appropriate type known in the art, such as incandescent, fluorescent or LED type. It shall be noted that the illumination device 296 can be comprised of a single or multiple units. Also the LED can be a multi-color unit where changing the polarity of the DC current changes the color emitted. An example would be a first green color emitted when a positive charge is induced and a second red color is emitted when a negative charge is induced. This is helpful when a stagehand or person in distress needs to communicate from a distance to signal the apparent status at that time. The accommodating powered tool handle unit 232, incorporates DPDT switches that are inherently designed to alternate the polarity of the DC current provided by the batteries 42 in accordance with the present invention.

FIGS. 17A–17C illustrate a multi-functional power tool, generally labeled with the reference character 330, according to a third exemplary embodiment of the present invention. Components, which are unchanged from the previous exemplary embodiments of the present invention depicted in FIGS. 3A–16C are labeled with the same reference characters. Components, which function in the same way as in the first exemplary embodiment of the present invention depicted in FIGS. 3A–12B are designated by the same reference numerals to which 300 has been added, sometimes without being described in detail since similarities between the corresponding parts in the two embodiments will be readily perceived by the reader.

The multi-functional power tool 330 of FIGS. 17A–17C corresponds substantially to the multi-functional power tool 230 of FIGS. 16A–16C, and only the portions of the electric handle connector and the electric head connector, which differ, will therefore be explained in detail below.

The multi-functional power tool 330 comprises a power tool handle unit 332 and a first interchangeable head unit 350 removably attachable to the tool handle unit 332. The power tool handle unit 332 has an electric handle connector 348 electrically coupled to the batteries 42 through the control switch assembly 40. Preferably, the electric handle connector 348 includes a single male pin 349. On the other hand, the head unit 350 has an electric head connector 368 located in the mating post 70 and electrically connected to the electric motor 45. More specifically, the electric head connector 368 includes a single connective female pin 369 adapted to receive the complementary single male pin 349. When the tool handle unit 332 and the first head unit 350 are united and secured to one another, the female pin 369 and the male pin 349 also connect and engage to each other providing the electrical power transfer between the two components, or between the electrical batteries 42 and the electric motor 45 via the control switch assembly 40.

Figure 18:
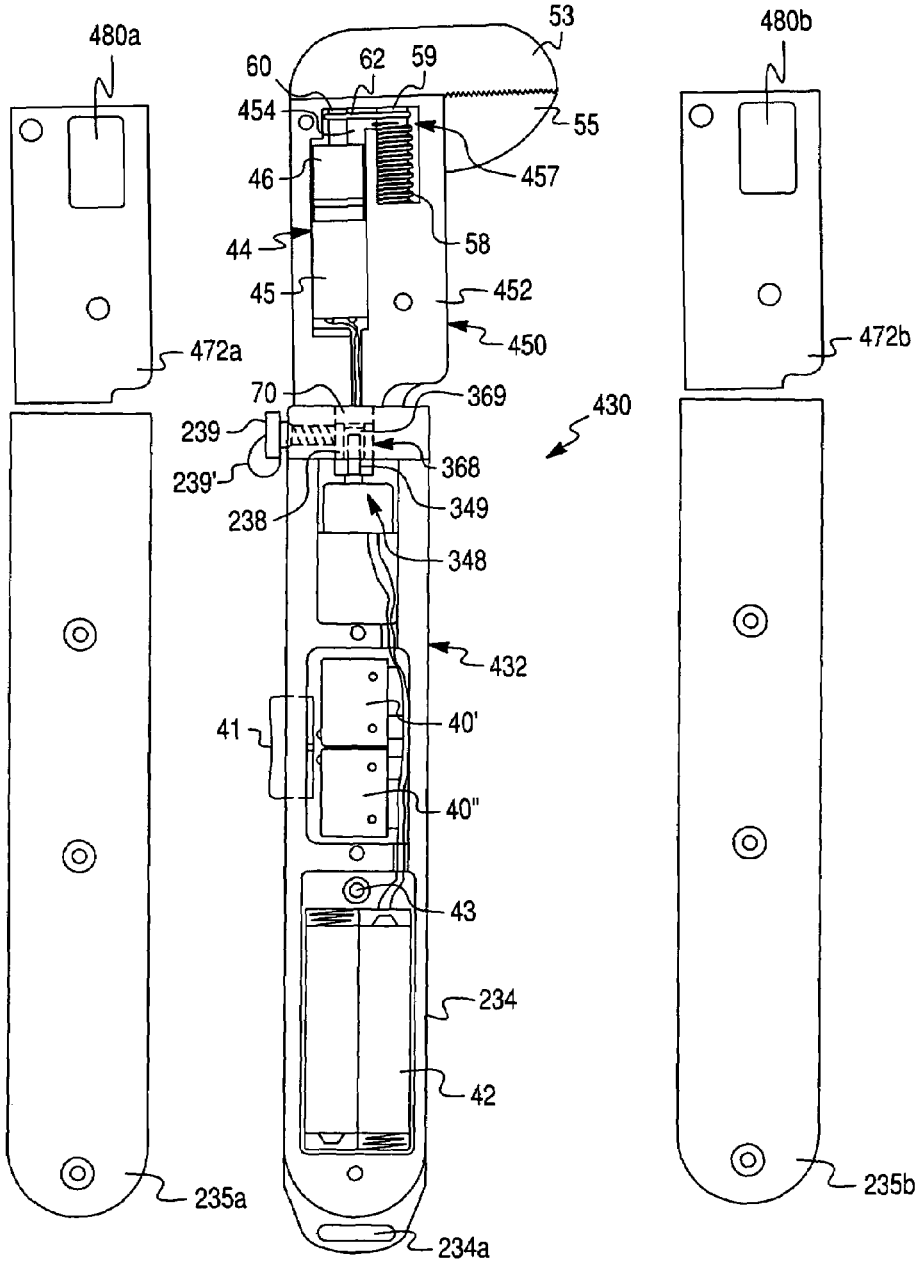
FIG. 18 is an exploded side view of a power tool in accordance with the fourth exemplary embodiment of the present invention.

FIG. 18 illustrate a multi-functional power tool, generally labeled with the reference character 430, according to a fourth exemplary embodiment of the present invention. Components, which are unchanged from the previous exemplary embodiments of the present invention depicted in FIGS. 3A–17C are labeled with the same reference characters. Components, which function in the same way as in the third exemplary embodiment of the present invention depicted in FIGS. 17A–17C are designated by the same reference numerals to which 400 has been added, sometimes without being described in detail since similarities between the corresponding parts in the two embodiments will be readily perceived by the reader.

The multi-functional power tool 430 comprises a power tool handle unit 432 and a first interchangeable head unit 450 removably attachable to the tool handle unit 432.

The power tool handle unit 432 is substantially identical to the handle unit 332 in accordance with the third exemplary embodiment of the present invention and includes the batteries 42, the control switch assembly 40 and the electric handle connector 348 electrically coupled to the batteries 42 through the control switch assembly 40. The interchangeable head unit 450 is a powered adjustable jaw pipe-wrench head comprising a unitary single-piece wrench head body member 452 provided with a stationary jaw 53, and a movable jaw 55 adjustable relative to the stationary jaw 53. The stationary jaw 53 is integral to the wrench head body member 452. Two cover members 472*a* and 472*b* fastened to the head body member 452 are used to contain all the components in the wrench head unit 450. The cover members 472*a* and 472*b* are provided with worm gear access windows 480*a* and 480*b*.

The adjustable jaw wrench head unit 450 further includes a drive mechanism 457 mounted to the head body member 452 within a cavity 454 formed therein. The drive mechanism 457 comprises a worm gear 58 and a first toothed sprocket 59 both rotatably mounted to the head body member 452 of the wrench head unit 450 coaxially with respect to each other. The worm gear 58 is operably connected to the toothed rack of the movable jaw 56 so that the rotatable movement of the worm gear 58 is transformed into the linear movement of the movable jaw 55 toward and away from the stationary jaw 53.

The drive mechanism 457 further comprises a self-contained transmission including first and second pulleys 59 and 60, respectively, connected by an endless toothed drive belt 62, to transfer rotary movement to the worm gear 58. The wrench head unit 450 further includes a power source 44 that comprises a reversible electric motor 45 and a gearbox 46 drivingly coupled to the electric motor 45. As illustrated in FIG. 18, the first pulley 59 is drivingly coupled to the worm gear 58, while the second pulley 60 is drivingly coupled to the power source 44. Thus, the power source 44 is employed for rotating the worm gear 58 through the drive mechanism 457.

Furthermore, the handle unit 432 has a fitting portion, while the first head unit 450 includes a fitting member provided to matingly engage the fitting portion of the handle unit 432 so as to removably secure the first head unit 450 to the handle unit 432. Preferably, the fitting member of the first head unit 450 is in the form of a hollow elongated post 70 extending from the head body member 452, while the fitting portion of the handle unit 432 is in the form of a mating post cavity 238 in the handle body member 234 provided to matingly receive the elongated post 70 of the coupling member of the first head unit 450 therein. Preferably, the elongated post 70 of the coupling member is formed integrally with the head body member 452 as a homogenous, unitary single-piece head part. The fitting portion of the handle unit 432 also includes at least one retractable spring plunger 239 provided with a pull ring 239' and disposed in the through opening 238' in the handle body member 234 and adapted to engage the complementary detent of the elongated post 70.

The first head unit 450 includes the electric head connector 368 electrically coupled to the electric motor 45 of the power source 44. The electric head connector 368 is complementary to the electric handle connector 348 and is provided to electrically connect the control switch assembly 40 to the power source 44 for selectively supplying electrical current form the batteries 42 to the electric motor 45. Preferably, as illustrated in FIG. 18, the electric head connector 368 and the electric handle connector 348 are substantially identical to the single pin head and handle connectors according to the third exemplary embodiment of the present invention.

FIGS. 19A–19D illustrate a multi-functional power tool according to a fifth exemplary embodiment of the present invention. Components, which are unchanged from the previous exemplary embodiments of the present invention are labeled with the same reference characters. Components, which function in the same way as in the second exemplary embodiment of the present invention depicted in FIGS. 16A–16C are designated by the same reference numerals to which 300 has been added, sometimes without being described in detail since similarities between the corresponding parts in the two embodiments will be readily perceived by the reader.

The multi-functional power tool according to the fifth exemplary embodiment of the present invention comprises an adaptive power tool handle unit 532 and an extension handle unit 582 removably attachable to the adaptive power tool handle unit 532.

Figure 19A:
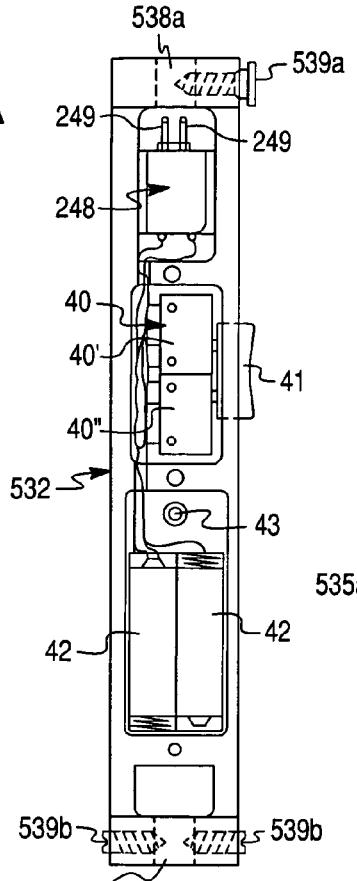
FIG. 19A is a side view of a power tool handle unit of a power tool in accordance with the fifth exemplary embodiment of the present invention.
Figure 19B:
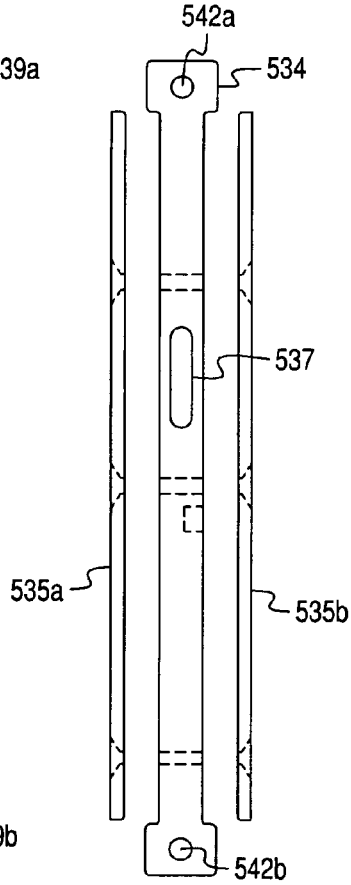
FIG. 19B is an exploded side view of a handle body member of the power tool in accordance with the fifth exemplary embodiment of the present invention.

The adaptive power tool handle unit 532, illustrated in FIGS. 19A and 19B, is substantially similar to the handle unit 232 in accordance with the second exemplary embodiment of the present invention and includes a unitary single-piece adaptive handle body member 534 formed with a plurality of inner compartments, and a pair of opposite handle covers 535*a* and 535*b* removably fastened to the adaptive handle body member 534, preferably by bolts or screws. The adaptive power tool handle unit 532 further includes the batteries 42, the control switch assembly 40, the electrical handle connector 248 electrically coupled to the batteries 42 through the control switch assembly 40, and the recharge port 43. Furthermore, the adaptive handle unit 532 has first and second post cavities 538*a* and 538*b*, respectively, provided at the opposite ends of the adaptive handle body member 534. As illustrated in FIG. 19A, the post cavity 538*a* is provided with a spring plunger 539*a*, while the opposite post cavity 538*b* is provided with two locking screws 539*b*. The post cavity 538*a* closest to the electrical handle connector 248 is provided to matingly receive the elongated post 70 of the coupling member of the compatible, interchangeable head unit therein, such as the adjustable wrench head unit 250 of the second exemplary embodiment of the present invention.

Figure 19C:
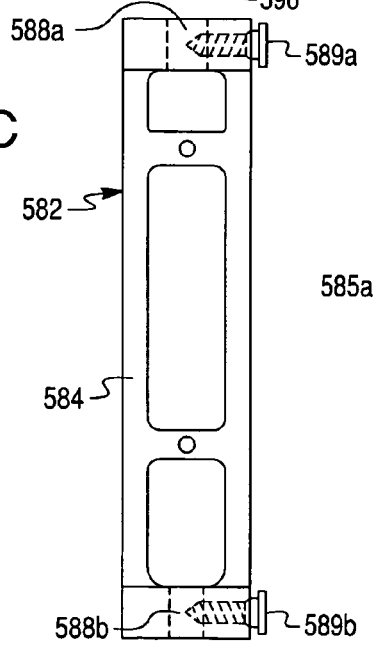
FIG. 19C is a side view of an extension tool handle of the power tool in accordance with the fifth exemplary embodiment of the present invention.
Figure 19D:
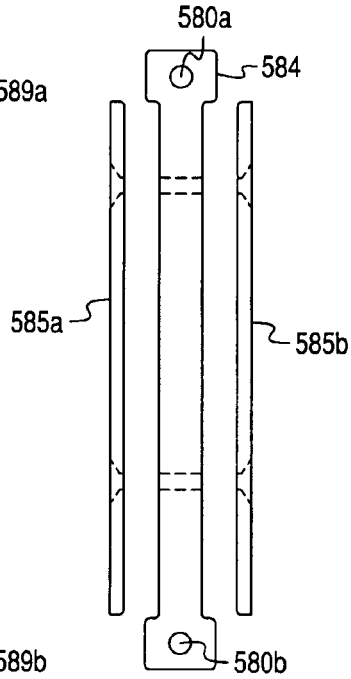
FIG. 19D is an exploded side view of a handle body member of the extension tool handle of the power tool in accordance with the fifth exemplary embodiment of the present invention.

The extension handle unit 582, illustrated in FIGS. 19C and 19D, comprises unitary single-piece extension handle body member 584 and a pair of opposite handle covers 585*a* and 585*b* removably fastened to the extension handle body member 584, preferably by bolts or screws. Furthermore, the extension handle unit 582 has first and second post cavities 588*a* and 588*b*, respectively, provided at the opposite ends of the extension handle body member 584. As illustrated in FIG. 19C, each of the post cavities 588*a* and 588*b* is provided with a spring plunger 589*a* and 589*b*, respectively.

The extension handle unit 582 is adapted to be connected to the adaptive power tool handle unit 532 via an adaptive extension post 590. One end of the adaptive extension post 590 is received into the distal end of the adaptive handle body member 534 of the adaptive power tool handle unit 532 at the post cavity 538*b* and is secured by the locking screws 539*b*. The other end of the adaptive extension post 590 is received into the distal end of the extension handle body member 584 of the extension power tool handle unit 582 at the post cavity 588*a* and is secured by the spring plunger 589*a*, thus attaching the extension handle unit 582 to the adaptive power tool handle unit 532.

FIGS. 20A–20D illustrate a multi-functional power tool according to a sixth exemplary embodiment of the present invention. Components, which are unchanged from the previous exemplary embodiments of the present invention are labeled with the same reference characters. Components, which function in the same way as in the firth exemplary embodiment of the present invention depicted in FIGS. 19A–19D are designated by the same reference numerals to which 100 has been added, sometimes without being described in detail since similarities between the corresponding parts in the two embodiments will be readily perceived by the reader.

The multi-functional power tool according to the sixth exemplary embodiment of the present invention comprises an adaptive power tool handle unit 532 and an extension handle unit 632 removably attachable to the power tool handle unit 532.

The adaptive power tool handle unit 532, illustrated in FIGS. 20C and 20D, is substantially identical to the adaptive power tool handle unit in accordance with the fifth exemplary embodiment of the present invention. FIG. 20C further shows a finishing end piece 670 having an integral bottom post 674 and detents 676. The finishing end piece 670 can be removably attached to the distal end of the adaptive power tool handle unit 532 (as illustrated in FIG. 20C) or to one end of the extension handle unit 632. The finishing end piece 670 is received via the post cavity 538*b* and secured by the locking screws 539*b*. The finishing end piece 670 incorporates a through slot 672 provided for attaching a wrench tether to, and connect to a belt loop for easy access and transporting.

The extension handle unit 632, illustrated in FIGS. 20A and 20B, comprises unitary single-piece extension handle body member 634 and a pair of opposite handle covers 635*a* and 635*b* removably fastened to the extension handle body member 634, preferably by bolts or screws. Furthermore, the extension handle unit 632 has a pair of post cavities 638*a* and 638*b* provided at the opposite ends of the extension handle body member 634. As illustrated in FIG. 20A, each of the post cavities 638*a* and 638*b* is provided with a locking screw 639*a* and a spring plunger 639*b*.

The extension handle unit 632 further comprises two opposite electrical handle connectors 648*a* and 648*b* disposed at the opposite ends of the extension handle body member 634 in compartments 636*a* and 636*b*, respectively, formed within the extension handle body member 634, as illustrated in FIG. 20A. Each of the electrical handle connectors 648*a* and 648*b* includes a pair of male conductive pins 649*a* and 649*b*, respectively.

The extension handle unit 632 is adapted to be connected to the adaptive power tool handle unit 532 via an adaptive extension post 650. The adaptive extension post 650 has two internal female pin connections 652 adapted to mate with the male conductive pins 249 of the electric handle connector 248 of the adaptive power tool handle unit 532 at one side of the adaptive extension post 650, and with the male conductive pins 649*a* of the electric handle connector 648*a* of the extension handle unit 632. The adaptive extension post 650 further has detents 654*a* and 654*b* located around an outer peripheral surface thereof.

One end of the adaptive extension post 650 is received into the distal end of the adaptive handle body member 534 of the adaptive power tool handle unit 532 at the post cavity 538*a* and is secured by the spring plunger 539*a* and the locking screw 539*b*. The other end of the adaptive extension post 650 is received into the distal end of the extension handle body member 634 of the extension power tool handle unit 632 at the post cavity 638*a* and is secured by the locking screw 639*a* and the spring plunger 639*b*, thus attaching the extension handle unit 632 to the adaptive power tool handle unit 532.

Therefore, the adaptive extension post 650 connects the extension handle unit 632 to the adaptive power tool handle unit 532 to mechanically secure them to each other and to transfer electrical power from the adaptive power tool handle unit 532 to one of the power head units, such as the adjustable wrench head unit 250 of the second exemplary embodiment of the present invention, through the adaptive extension post 650. Thus, it is possible to build a longer handle by adding one or more extension handle unit 632 and securing them to each other with the adaptive extension posts 650 between each extension handle unit 632.

Interchangeable power head units having the appropriate electrical connector configuration as shown in FIGS. 16A, 16D–16F, 17A and 18 may be utilized with the extension handle unit 632 of FIG. 20A and the adaptive power tool handle unit 532 of FIG. 20C. It will further be appreciated that it is possible to selectively choose the position, or placement, of the adaptive power tool handle unit 532 of FIG. 20C when adding the extension handle units 632. This is achieved by adding or subtracting the extension handle units 632 in front of or in the back of the adaptive power tool handle unit 532, and utilizing a combination of the extension handle units 582 and 632 of FIGS. 19C and 20A, respectively.

Moreover, the position of the adaptive power tool handle unit 532 relative the extended handle units 632 defines the position where the user desires the location of the switch actuator 41 on the extended handle to be. This is beneficial where the reach is more important than the leverage and when actuation of the switch actuator is restricted to tight areas. It will further be appreciated that any interchangeable power head units of the present invention having the electrical connectors is compatible with the adaptable power tool handle unit and the extension handle units of the present invention.

FIGS. 21A–21D illustrate a multi-functional tool 730 according to a seventh exemplary embodiment of the present invention. Components, which are unchanged from the previous exemplary embodiments of the present invention are labeled with the same reference characters, sometimes without being described in detail since similarities between the corresponding parts in the two embodiments will be readily perceived by the reader.

The multi-functional tool 730 comprises a tool handle unit 732 and a first interchangeable head unit 750 removably attachable to the tool handle unit 732.

As illustrated, the first head unit 750 is an adjustable jaw wrench head unit comprising an integral first head body member 752 defining a stationary jaw 53, and a moveable jaw 55 adjustable relative to the stationary jaw 53. The movable jaw 55 is formed integral with a toothed rack 56, as shown in FIG. 4. The first head unit 750 further includes a manually operable worm gear 58 operably connected to the toothed rack 56 of the movable jaw 55 so that the rotatable movement of the worm gear 58 is transformed into the linear movement of the movable jaw 55 toward and away from the stationary jaw 53. The head body member 752 has an integral bottom post 70, and at least one detent 70*a* located around the perimeter of the bottom post 70.

The multi-functional tool 730 according to a seventh exemplary embodiment of the present invention is able to receive a plurality of interchangeable head units via a mating post cavity 38 in the handle body member 734 provided to matingly receive the bottom post 70, and secured by a spring plunger 39. Preferably, the bottom post 70 is formed integrally with the head body member 752 as a homogenous, unitary single-piece head part. The tool handle body member 734 can be manufactured out of steel, zinc alloy, aluminum, aluminum bronze or a composite plastic.

Located at the distal end of tool handle unit 732, is a thru slot 734*a* provided for attaching a wrench tether to, and connect to a belt loop for easy access and transporting. FIG. 21B is a side view of the tool handle unit 732 of the seventh exemplary embodiment of the present invention, incorporating a hole sleeve 772 press fitted into a post cavity 38, and bisected by a spring plunger 39. It will be appreciated that a hole sleeve 772 can be added to any of the previous embodiments of the tool handle unit. The hole sleeve 772 preferably has a substantially cylindrical outer peripheral surface and an internal geometric shape, such as a square or hexagonal, as shown in FIGS. 21C and 21D, respectively. The hole sleeve 772 is used in the present invention to strengthen the post cavity 38 and to convert a round hole to any geometric shape such as a square or hexagon, or even a spline. The hole sleeve 772 includes at least one detent 773 adapted to receive a complementary tip of the spring plunger 39 in order to secure the hole sleeve 772 within the post cavity 38 of the tool handle unit 732. Preferably, the hole sleeve 772 is made of metal, such as steel, and is especially beneficial when used in combination with a plastic handle unit to add necessary strength.

FIGS. 22A–22E illustrate various interchangeable tool head units for the multi-functional tool 730 according to the seventh exemplary embodiment of the present invention adapted to be removably secured to the tool handle unit 732.

FIG. 22A shows a second interchangeable tool head unit 780 comprising a body member 782 formed integrally with a bottom post 70 having detents 70*a*, a removable saw blade 784 and a set screw 785 used to lock the saw blade 784 in tool body member 782. The bottom post 70 of the tool head unit 780 is adapted to be inserted into the post cavity 38 in the tool handle unit 732 and secured therein with the spring plunger 39 engaging the detents 70*a* of the bottom post 70.

FIG. 22B shows a third interchangeable tool head unit 786 comprising a body member 788 formed integrally with a bottom post 70 having detents 70*a*, and a pointed awl 789 integrally mounted to the body member 788.

FIG. 22C shows a fourth interchangeable tool head unit 790 comprising a body member 792 formed integrally with a bottom post 70 having detents 70*a*, a saw blade holder 794 integrally mounted to the body member 792, a removable saw blade 796 and a set screw 795 used to lock the saw blade 784 to the saw blade holder 794.

FIG. 22D shows a fifth interchangeable tool head unit 796 comprising a body member 798 formed integrally with a bottom post 70 having detents 70*a*, and a removable razor blade 799 that slides into place via a slot in the body member 798.

FIG. 22E shows a sixth interchangeable tool head unit 800 comprising a body member 802 formed integrally with a bottom post 70 having detents 70*a*, a removable angled razor blade 804 and a set screw 805 used to lock the razor blade 804 in tool body member 802.

Figure 22F:
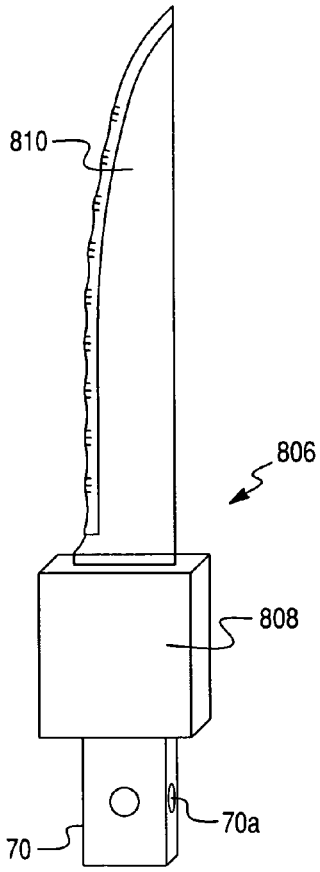
FIG. 22F is a side view of a seventh interchangeable tool head in accordance with the seventh exemplary embodiment of the present invention.

FIG. 22F shows a seventh interchangeable tool head unit 806 comprising a body member 808 formed integrally with the bottom post 70 having detents 70*a*, and a knife blade 810 integrally mounted to the body member 808.

Figure 22G:
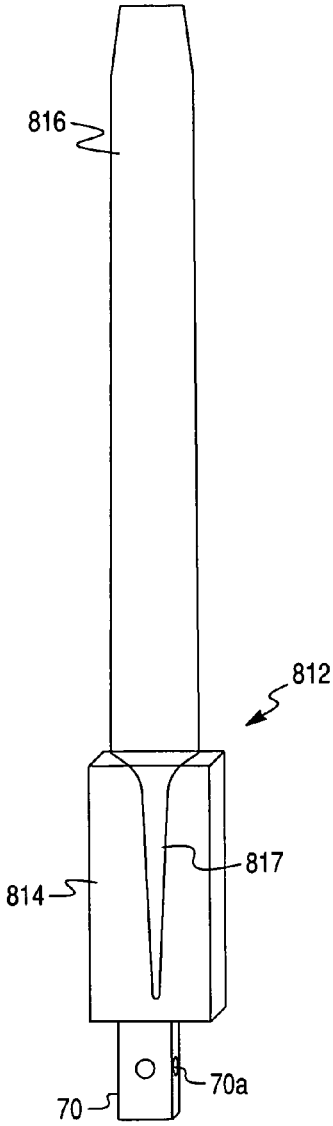
FIG. 22G is a side view of a eighth interchangeable tool head in accordance with the seventh exemplary embodiment of the present invention.

FIG. 22G shows a eighth interchangeable tool head unit 812 comprising a body member 814 formed integrally with the bottom post 70 having detents 70*a*, and a removable file 816 and a set screw 817 used to lock the file 816 to the body member 814.

Figure 22H:
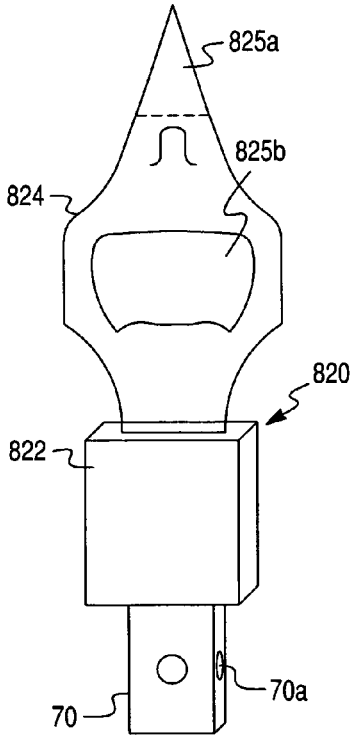
FIG. 22H is a side view of a ninth interchangeable tool head in accordance with the seventh exemplary embodiment of the present invention.

FIG. 22H shows a ninth interchangeable tool head unit 820 comprising a body member 822 formed integrally with a bottom post 70 having detents 70*a*, and a opener 824 integrally mounted to the body member 822. The opener 824 includes a upper portion can opener 825*a* and a lower portion bottle opener 825*b*.

Figures 23A, 23B, 23C:
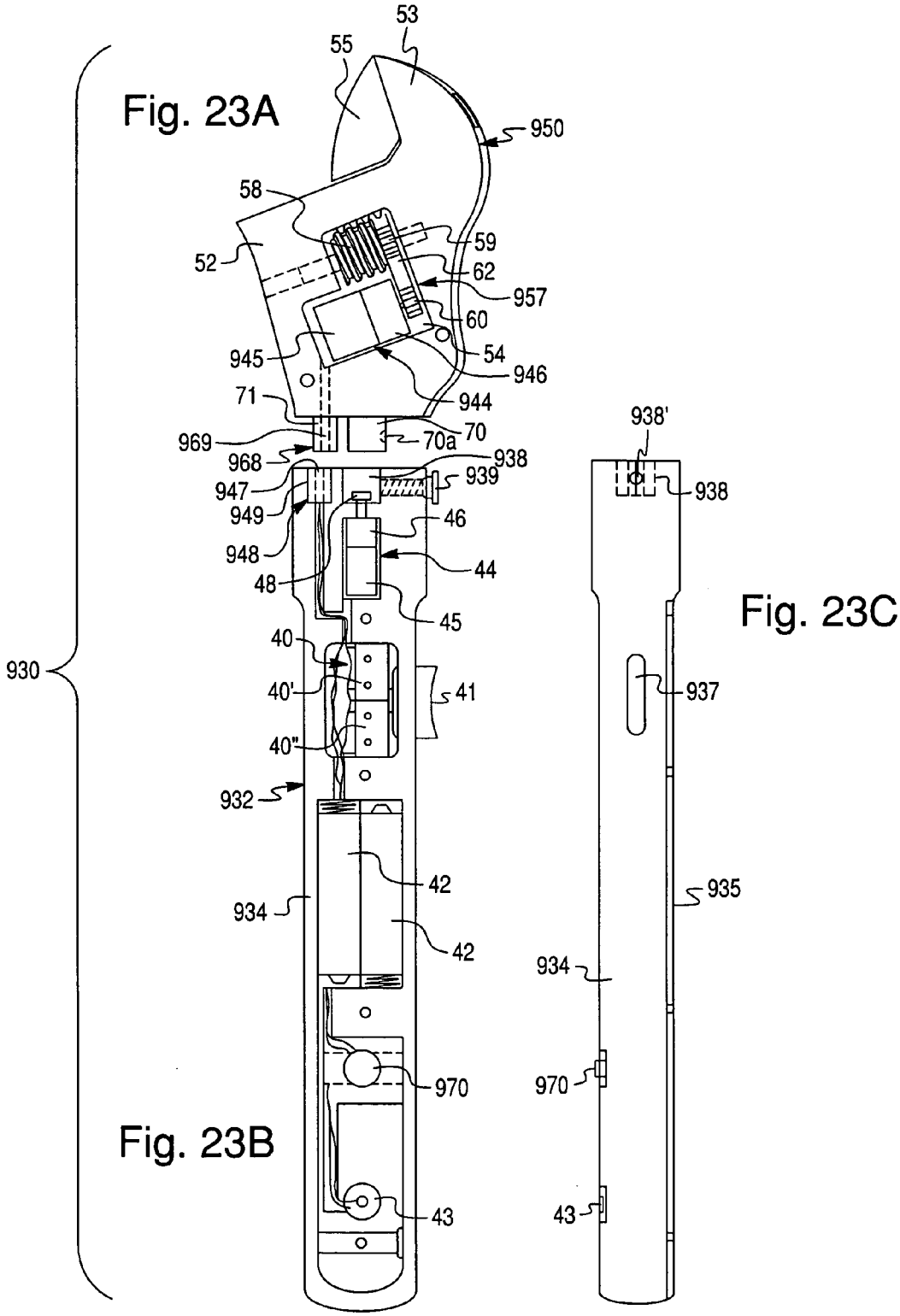
FIG. 23A is a side view of an interchangeable powered adjustable jaw wrench head unit in accordance with an eighth exemplary embodiment of the present invention.
FIG. 23B is a side view of a power tool handle unit in accordance with the eighth exemplary embodiment of the present invention.
FIG. 23C is a front view of a handle body member and cover of the power tool handle unit in accordance with the eighth exemplary embodiment of the present invention.

FIGS. 23A–23C illustrates a multi-functional power tool, generally labeled with the reference character 930, according to an eighth exemplary embodiment of the present invention. Components, which function in the same ways as in the first exemplary embodiment of the present invention depicted in FIGS. 3A–16C are labeled with the same reference characters. Components, which function in the same way as in the first exemplary embodiment of the present invention depicted in FIGS. 3A–12B are designated by the same reference numerals which 900 has been added, sometimes without being described in detail since similarities between the corresponding parts in the two embodiments will be readily perceived by the reader.

The multi-functional power tool 930 comprises a power tool handle unit 932 and a first interchangeable head unit 950 removably attachable to the tool handle unit 932.

As illustrated in FIGS. 23B and 23C, the handle unit 932 includes an integral handle body member 934 and a handle cover 235 removably fastened to the handle body member 934, preferably by bolts or screws. The handle body member 934 in accordance with the eighth embodiment of the present invention, further comprises of a plurality of compartments to contain internal components of the handle unit 932: a power source compartment, a switch compartment, and a battery compartment. Preferably, the handle body member 34, illustrated further in detail in FIG. 3B–3D, is a unitary single-piece part. It will be appreciated by those skilled in the art that the handle body member 34 may be made of any appropriate material such as metal (steel, aluminum, zinc alloy, etc.) or plastic material.

As further illustrated in FIG. 23B, the handle unit 932 comprises a first power source 44 including a reversible electric motor 45 and a gearbox 46 drivingly coupled to the electric motor 45. The electric motor 45 is electrically connected to a control switch assembly 40 including a switch actuator 41 controlling operation of the electric motor 45, and to at least one electric battery 42 supplying electric power to the motor 45 and the control switch assembly 40. Preferably, as shown in FIG. 23B, two batteries 42 are provided. The batteries 42 may be rechargeable. In this case, a recharge port 43 is used for recharging the batteries 42. Any appropriate type of electrical switches known in the prior art may be utilized in the present invention, such as a double pole double throw (DPDT) switch. Preferably, the control switch assembly 40 includes a pair of single pole double throw (SPDT) switches 40' and 40" and the single switch actuator 41, as shown in FIG. 23B.

FIG. 23A illustrates the preferred embodiment of the first head unit 950 of the power tool 930 in accordance with the eighth exemplary embodiment of the present invention. As illustrated, the first head unit 950 is an adjustable jaw wrench head unit comprising an integral head body member 52 defining a stationary jaw 53, and a moveable sliding jaw 55 adjustable relative to the stationary jaw 53. The head body member 52 further defines a cavity 54 therein to provide a space for internal components of the adjustable jaw wrench head unit 50.

Preferably, the head body member 52 is a unitary single-piece part. It will be appreciated by those skilled in the art that the head body member 52 may be made of any appropriate material such as metal (steel, aluminum, zinc alloy, etc.) or plastic material.

The adjustable jaw wrench head unit 950 according to the present invention further includes a drive mechanism 957 mounted to the head body member 52 within the cavity 54 formed therein. The drive mechanism 957 according to the eighth exemplary embodiment of the present invention, comprises a worm gear 58 and a first toothed sprocket 59 both rotatably mounted to the head body member 52 of the wrench head unit 950 coaxially with respect to each other. The worm gear 58 is operably connected to the toothed rack 56 of the movable jaw 55 so that the rotatable movement of the worm gear 58 is transformed into the linear movement of the movable jaw 55 toward and away from the stationary jaw 53.

The drive mechanism 957 further comprises a self-contained transmission including a second toothed sprocket 60 connected to the first toothed sprocket 59 by an endless toothed drive belt 62, to transfer rotary movement to the worm gear 58. The wrench head unit 950 further includes a second power source 944. The second power source 944 comprises a reversible electric motor 945 and a gearbox 946 drivingly coupled to the electric motor 945. As illustrated in FIG. 23A, the first toothed sprocket 59 is drivingly coupled to the worm gear 58, while the second toothed sprocket 60 is drivingly coupled to the second power source 944. Thus, the second power source 944 is employed for rotating the worm gear 58 through the drive mechanism 257.

Furthermore, the handle unit 932 has a fitting portion, while the first head unit 950 includes a first fitting member provided to matingly engage the fitting portion of the handle unit 932 so as to removably secure the first head unit 950 to the handle unit 932. The fitting member of the first head unit 950 according to the eighth embodiment of the present invention is in the form of a first hollow elongated mating post 70 and a second elongated mating post 71 both extending from a head body member 952, while the fitting portion of the handle unit 932 is in the form of first and second mating post cavities 938 and 947, respectively, formed in a handle body member 934 provided to matingly receive the first and second elongated mating posts 70 and 71, respectively, of the fitting member of the first head unit 950 therein. Preferably, the elongated posts 70 and 71 of the fitting member is formed integrally with the head body member 952 as a homogenous, unitary single-piece head part.

The power tool handle unit 932 is dual functional, incorporating both a mechanical handle coupling device 48 and an electric handle connector 948. The mechanical handle coupling device 48 is disposed within the first mating post cavity 938, while the electric handle connector 948 is disposed within the second mating post cavity 947.

The mechanical handle coupling device 48 provides the option to matingly engage the complimentary mechanical head coupling device 68 of the compatible, interchangeable first head unit 50 according to the first exemplary embodiment of the present invention illustrated in FIG. 3A, or the complimentary mechanical head coupling device 168 of the second interchangeable head unit 150 in accordance with the first exemplary embodiment of the present invention illustrated in FIG. 14A. The power source 44 includes the attached mechanical handle coupling device 48 and provides the mechanical output. The batteries 42 and the control switch assembly 40 are connectively coupled to provide the power and function to the power source 44.

Similarly, the electric handle connector 948 provides the option to matingly engage the complimentary electric head connector 968 of the compatible, interchangeable first head unit 950 according to the eighth exemplary embodiment of the present invention illustrated in FIG. 23A. The electric head connector 968 is disposed within the second mating post 71.

The electric handle connector 948 preferably includes a single connective male pin 949, while the electric head connector 968 includes a single female connector 969. The male pin 949 of the electric handle connector 948 matingly engages the female connector 969 of the electric head connector 968 of the complimentary first interchangeable head unit 950. The male pin 949 of the electric handle connector 948 of the power tool handle unit 932 is electrically coupled to the batteries 42 through the control switch assembly 40, and is further electrically connected to an independent on/off switch 970 located at the distal end of the power tool handle unit 932. Thus, stored power from the batteries 42 is applied equally to both the switch assembly 40 and the independent on/off switch 970. Power transferred to the switch assembly 40 controls the function of both the power source 44 and the electric handle connector 948. However, power transferred to the independent on/off switch 970 will control only the function of the electric handle connector 948 of the power tool handle unit 932.

Figure 24A:
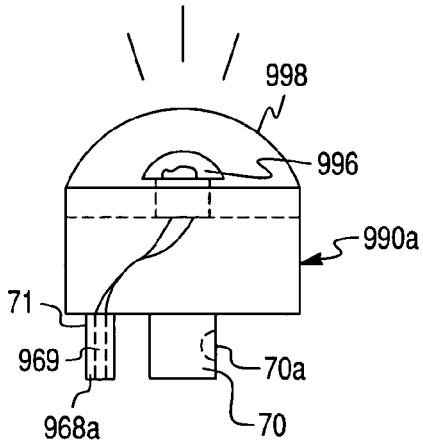
FIG. 24A is a side view of a second head unit in accordance with the eighth exemplary embodiment of the present invention.
Figure 24B:
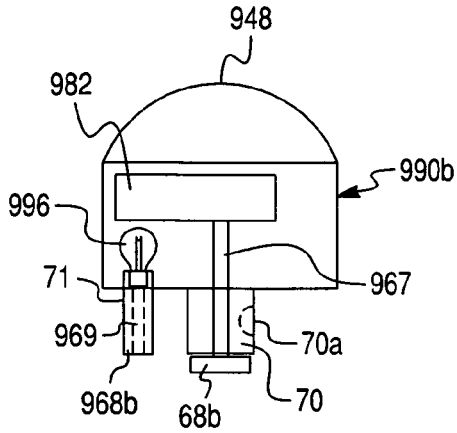
FIG. 24B is a side view of a third head unit in accordance with the eighth exemplary embodiment of the present invention.
Figure 24C:
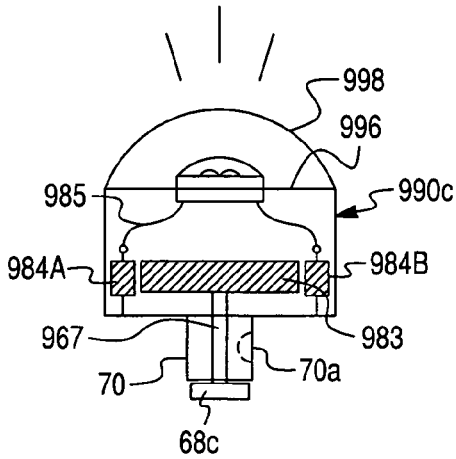
FIG. 24C is a side view of a fourth head unit in accordance with the eighth exemplary embodiment of the present invention.

FIGS. 24A–24C illustrate interchangeable head units utilized with the multi-functional tool handle unit 932 of the eighth exemplary embodiment of the present invention. More specifically, FIG. 24A illustrates an interchangeable powered illumination device 990*a*, FIG. 24B illustrates an interchangeable powered emergency/strobe-light device 990*b*, and FIG. 24C illustrates an interchangeable powered generator/light device 990*c*.

FIG. 24A is the second interchangeable head unit 990*a* removably attachable to the tool handle unit 932 via a second fitting member including first and second hollow elongated mating posts 70 and 71, respectively, both extending from the third head unit 990*a*. The first mating post 70, incorporating a detent 70*a* is used primarily as a guide and securing means to the power tool handle unit 932.

The second elongated post 71 of FIG. 24A contains an electric head connector 968*a*, preferably having a single female connector 969 connectively to an illumination device 996, such as LED. The second elongated post 71 matingly engages at the receiving mating post cavity 947 of the power tool handle 932. Electrical power provided from the batteries 42 in the power tool handle 932 is transferred to the switch assembly 40 and activation of the switch assembly 40 controls the function of the illumination device 996. Furthermore, electrical power provided from the batteries 42 in the power tool handle 932 is also transferred to the independent on/off switch 970 and activation of the on/off switch 970 can independently control the function of the illumination device 996. A magnifying cover 998 enhances brilliance and light coverage.

FIG. 24B is the third interchangeable head unit 990*b* removably attachable to the tool handle unit 932 via a third fitting member including first and second hollow elongated mating posts 70 and 71, respectively, both extending from the fourth head unit 990*b*. The first elongated post 70, incorporating a detent 70*a* is used as a securing means and contains a mechanical head coupling device 68*b* and a power take-off shaft 967.

The second elongated post 71 of FIG. 24B contains an electric head connector 968*b*, preferably having a single female connector 969 connectively to an illumination device 996. Electrical power provided from the batteries 42 in the power tool handle 932 is transferred to the switch assembly 40 and activation of the switch assembly 40 simultaneously provides power to the motor 45 in the handle unit 932 and to the illumination device 996. Mechanical power is transferred from the motor 45 and the handle coupling device 48 to a head coupling device 68*b*, in turn rotating the take-off shaft 967 and an eccentric disc 982 in head unit 990*b*. Simultaneously, electrical power transferred from the electric handle connector 948 to the electric head connector 968*b* powers the illumination device 996 in the head unit 990*b*. Rotation of the eccentric disc 982 interrupts the light emitted from the illumination device 996 creating a strobe effect which is useful for warnings and emergency awareness. The magnifying cover 998 enhances brilliance and light coverage.

FIG. 24C is the fourth interchangeable head unit 990*c* removably attachable to the tool handle unit 932 via a fourth fitting member including first and second hollow elongated mating posts 70 and 71, respectively, both extending from the fifth head unit 990*c*. The first elongated post 70, incorporating a detent 70*a* is used as a securing means and contains a mechanical head coupling device 68 and a power take-off shaft 967.

Electrical power provided from the batteries 42 in the power tool handle 932 is transferred to the switch assembly 40 and activation of the switch assembly 40 provides power to the motor 45 and the handle coupling device 48. Mechanical power transferred from the handle coupling device 48 to a head coupling device 68*c* rotates the power take-off shaft 967 and an attached armature winding disc 983. Opposing magnets 984A and 984B spaced around the armature winding disc 983 absorb resistive electrical energy and that energy is transferred from the magnets 984A and 948B through wires 985 to the illumination device 996. Thus, the fourth interchangeable head unit 990*c* acts as an electrical generator providing electrical current to the illumination device 996.

With the above description of the multi-functional power tool 930, one skilled in the art realizes that various mechanical and electrical interchangeable head units of the present invention having one or two integral elongated mating posts can be adapted and utilized with the power tool handle unit 932. Furthermore, dual switches 40 and 970 provided on the power tool handle unit 932 allow the user to choose independent or multiple control functions of the interchangeable head units of the present invention.

Therefore, a multi-functional tool in accordance with the present invention includes a novel arrangement of an extendable tool handle unit with an interchangeable connect feature able to receive and power various size adaptable, interchangeable adjustable wrench head units and other adaptable tool attachments. The interchangeable adjustable wrench head units varying in size are easily connected and disconnected to the tool handle unit.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A multi-functional tool comprising:

a tool handle unit including a handle body member having a fitting portion; and a first tool head unit removably attachable to said handle unit;

said first head unit having a first fitting member provided to matingly engage said fitting portion of said handle unit so as to removably secure said first head unit to said handle unit;

wherein said first head unit is an adjustable jaw wrench comprising:

a head body member defining a stationary jaw;

a movable jaw reciprocally mounted to said head body member in alignment with said stationary jaw, said movable jaw including a gear rack portion;

a drive mechanism mounted to said head body member of said first head unit, said drive mechanism being operably coupled to said movable jaw for moving said movable jaw relative to said stationary jaw, said drive mechanism including a worm gear rotatably mounted in said head body, said worm gear engaging said gear rack portion of said movable jaw; and a power source driving said drive mechanism, said power source disposed in one of said handle unit and said first head unit.

2. The multi-functional tool as defined in claim 1, wherein said handle unit of said multi-functional tool includes at least one electric battery disposed in said handle body member of said handle unit.

3. The multi-functional tool as defined in claim 2, wherein said power source includes a reversible electric motor.

4. The multi-functional tool as defined in claim 3, wherein said power source includes a gearbox drivingly coupled to said reversible electric motor.

5. The multi-functional tool as defined in claim 2, further including a control switch assembly disposed in said handle body member of said handle unit and electrically connected to said at least one electric battery for controlling said power source.

6. The multi-functional tool as defined in claim 2, wherein said handle unit of said multi-functional tool includes a recharge port used for recharging said at least one electric battery.

7. The multi-functional tool as defined in claim 5, wherein said control switch assembly includes two single pole double throw switches and a switch actuator.

8. The multi-functional tool as defined in claim 5, wherein said control switch assembly includes a single double pole double throw switch and a switch actuator.

9. The multi-functional tool as defined in claim 5, wherein said handle unit is electrically connected to an externally supplied battery pack, DC plug adapter or transformer.

10. The multi-functional tool as defined in claim 5, wherein said power source is disposed in said handle unit, and wherein said tool handle unit includes a mechanical handle coupling device operatively coupled to an output shaft of said power source.

11. The multi-functional tool as defined in claim 10, wherein said first head unit includes a mechanical head coupling device operatively coupled to said drive mechanism, and wherein said head coupling device is complementary to said handle coupling device and is provided to drivingly couple said power source to said drive mechanism when said first head unit is coupled to said tool handle unit.

12. The multi-functional tool as defined in claim 11, wherein said handle coupling device is provided with a drive cam and said complementary head coupling device is provided with a driven cam adapted to positively engage said drive cam of said handle coupling device to transfer drive torque from said power source to said drive mechanism of said first head unit.

13. The multi-functional tool as defined in claim 11, wherein at least one of said handle coupling device and said head coupling device includes a magnet provided to firmly engage the other one of said handle coupling device and said head coupling device with a magnetic force enough to transfer drive torque from said power source to said drive mechanism of said first head unit.

14. The multi-functional tool as defined in claim 11, wherein said handle coupling device and said complementary head coupling device are provided with complementary gear or ratchet teeth adapted to positively engage each other to transfer drive torque from said power source to said drive mechanism of said first head unit.

15. The multi-functional tool as defined in claim 11, wherein one of said handle coupling device and said head coupling device is provided with a tang and the other one of said handle coupling device and said head coupling device is provided with a complementary slot provided to positively engage said tang to transfer drive torque from said power source to said drive mechanism of said first head unit.

16. The multi-functional tool as defined in claim 11, wherein a compressible spring is disposed between said handle coupling device and said complementary head coupling device to transfer drive torque from said power source to said drive mechanism of said first head unit.

17. The multi-functional tool as defined in claim 10, further comprising a second tool head unit having a fitting member provided to matingly engage said fitting portion of said handle unit so as to removably secure said second head unit to said handle unit.

18. The multi-functional tool as defined in claim 17, wherein said second tool head unit has a head coupling device complementary to said handle coupling device provided to drivingly couple said power source of handle unit to said drive mechanism of said second head unit.

19. The multi-functional tool as defined in claim 18, wherein said second tool head unit further including tool bit holder spindle operatively coupled to said head coupling device and provided to accept various tools.

20. The multi-functional tool as defined in claim 5, wherein said power source is disposed in said first head unit, and wherein said tool handle unit includes an electric handle connector electrically coupled to said at least one battery through said control switch assembly.

21. The multi-functional tool as defined in claim 20, wherein said first head unit includes an electric head connector complementary to said electric handle connector and is provided to electrically connect said control switch assembly to said power source for selectively supplying electrical current form said at least one battery to said power source when said first head unit is coupled to said tool handle unit.

22. The multi-functional tool as defined in claim 21, wherein said electric handle connector includes one of a pair of male pins and a complimentary pair of female pins, and said electric head connector includes the other one of said pair of male pins and said pair of female pins; said pair of female pins is adapted to receive said pair of male pins.

23. The multi-functional tool as defined in claim 20, further comprising a second tool head unit having a fitting member provided to matingly engage said fitting portion of said handle unit so as to removably secure said second head unit to said handle unit; said second tool head unit includes a second power source.

24. The multi-functional tool as defined in claim 23, wherein said tool handle unit includes an electric handle connector electrically coupled to said at least one battery through said control switch assembly, and wherein said second head unit includes a second electric head connector complementary to said electric handle connector provided to electrically connect said control switch assembly in said handle unit to said power source in said second head unit for selectively supplying electrical current form said at least one battery to said power source when said second head unit is coupled to said tool handle unit.

25. The multi-functional tool as defined in claim 23, wherein said second power source includes a reversible electric motor.

26. The multi-functional tool as defined in claim 25, wherein said second power source includes a gearbox drivingly coupled to said reversible electric motor.

27. The multi-functional tool as defined in claim 21, wherein said electric handle connector includes one of a single male pin and a complimentary single female pin, and said electric head connector includes the other one of said single male pin and said single female pin; said single female pin is adapted to receive said single male pin.

28. The multi-functional tool as defined in claim 20, further comprising a third tool head unit having a fitting member provided to matingly engage said fitting portion of said handle unit so as to removably secure said third head unit to said handle unit; said third tool head unit includes a third power source.

29. The multi-functional tool as defined in claim 28, wherein said tool handle unit includes an electric handle connector electrically coupled to said at least one battery through said control switch assembly, and wherein said third head unit includes a third electric head connector complementary to said electric handle connector provided to electrically connect said control switch assembly in said handle unit to said power source in said third head unit for selectively supplying electrical current form said at least one battery to said third power source when said third head unit is coupled to said tool handle unit.

30. The multi-functional tool as defined in claim 29, wherein said third tool head unit further including tool bit holder spindle operatively coupled to said head coupling device and provided to accept various tools.

31. The multi-functional tool as defined in claim 28, wherein said third power source includes a reversible electric motor.

32. The multi-functional tool as defined in claim 31, wherein said third power source includes a gearbox drivingly coupled to said reversible electric motor.

33. The multi-functional tool as defined in claim 20, further comprising a fourth tool head unit having a fitting member provided to matingly engage said fitting portion of said handle unit so as to removably secure said fourth head unit to said handle unit.

34. The multi-functional tool as defined in claim 33, wherein said fourth tool head unit includes at least one illumination device.

35. The multi-functional tool as defined in claim 34, wherein said at least one illumination device is in the form of one of an incandescent bulb, a fluorescent lamp and LED.

36. The multi-functional tool as defined in claim 34, wherein said tool handle unit includes an electric handle connector electrically coupled to said at least one battery through said control switch assembly, and wherein said fourth head unit includes a fourth electric head connector complementary to said electric handle connector provided to electrically connect said control switch assembly in said handle unit to said at least one illumination device in said fourth head unit for selectively supplying electrical current form said at least one battery to said at least one illumination device when said fourth head unit is coupled to said tool handle unit.

37. The multi-functional tool as defined in claim 34, wherein said fourth tool head unit further includes a magnifying lens covering said at least one illumination device.

38. The multi-functional tool as defined in claim 34, wherein said at least one illumination device is a multi-color LED where a change of a polarity of a DC current from said at least one battery changes the color emitted by said multi-color LED.

39. The multi-functional tool as defined in claim 2, further including a plurality of said first tool head units of various size proportions to accommodate a large range of fasteners and fittings.

40. The multi-functional tool as defined in claim 2, wherein said fitting portion of said tool handle unit includes a mating cavity in said handle body member.

41. The multi-functional tool as defined in claim 40, wherein said fitting member of said first head unit includes an elongated post extending from said head body member provided to be matingly received in said mating cavity in said handle body member.

42. The multi-functional tool as defined in claim 41, wherein said elongated post incorporates at least one detent formed on an outer peripheral surface thereof, and said mating cavity in said handle body member is provided with at least one locking member releasably engaging said at least one detent to secure said first head unit to said tool handle unit.

43. The multi-functional tool as defined in claim 42, wherein said at least one locking member is one of a quick disconnect spring loaded pin, a quick disconnect spring loaded ball, a threaded fastener, a cam action plunger, a ratchet pawl, a hand retractable spring biased plunger with a lock-out feature, a hand retractable spring biased plunger without a lock-out feature and a spring loaded paddle latch adapted to be received in a groove formed on a outer peripheral surface of said elongated post.

44. The multi-functional tool as defined in claim 41, wherein said elongated post has one of a square, rectangle, hexagon, splined serrated and circular cross-section and said mating cavity in said handle body member has a cross-section complimentary to the cross-section of said elongated post of said first head unit.

45. The multi-functional tool as defined in claim 44, wherein said elongated post of said first head unit incorporates multiple detents formed on an outer peripheral surface thereof.

46. The multi-functional tool as defined in claim 44, wherein said mating cavity in said handle body member has a cross-section complimentary to the cross-section of said elongated post of said first head unit establishing indexing provisions to selectively rotate the position of said first head unit relative to a work; and wherein the rotation of the said first head unit in relation to the said handle body member and said switch facilitates a correct and true right and left hand use of the said first head unit.

47. The multi-functional tool as defined in claim 2, wherein said fitting portion of said tool handle unit includes a cavity in said handle body member and a hole sleeve disposed in said cavity; said hole sleeve defining a sleeve cavity.

48. The multi-functional tool as defined in claim 47, wherein said hole sleeve is secured within said cavity in said tool handle unit.

49. The multi-functional tool as defined in claim 48, wherein said hole sleeve is press fitted into said cavity in said tool handle unit.

50. The multi-functional tool as defined in claim 47, wherein said fitting member of said first head unit includes an elongated post extending from said head body member provided to be matingly received in said sleeve cavity in said hole sleeve.

51. The multi-functional tool as defined in claim 2, further comprising a plurality of interchangeable tool head units each having a fitting member provided to matingly engage said fitting portion of said handle unit so as to removably secure each of said plurality of interchangeable tool head units to said tool handle unit.

52. The multi-functional tool as defined in claim 51, wherein said plurality of interchangeable tool head units includes a handsaw, a pointed awl, a hacksaw, a removable razor blade, a removable angled razor blade, a knife blade, a file and an opener.

53. The multi-functional tool as defined in claim 2, wherein said handle body member of said tool handle unit is a unitary single-piece part.

54. The multi-functional tool as defined in claim 53, wherein said handle body member of said tool handle unit defines at least one compartment for housing one of said at least one battery and said control switch assembly, said handle body member further including at least one handle cover member removably secured to said handle body member of said tool handle unit for closing said at least one compartment.

55. The multi-functional tool as defined in claim 53, wherein said handle body member of said tool handle unit is made of plastic material by an injection molding process.

56. The multi-functional tool as defined in claim 53, wherein said handle body member of said tool handle unit is made of metal by one of forging process and casting process.

57. The multi-functional tool as defined in claim 56, wherein said metal is one of steel, zinc alloy, aluminum and aluminum bronze.

58. The multi-functional tool as defined in claim 2, wherein said head body member of said first head unit a unitary single-piece part.

59. The multi-functional tool as defined in claim 58, wherein said head body member of said first head unit is made of plastic material by an injection molding process.

60. The multi-functional tool as defined in claim 58, wherein said head body member of said first head unit is made of metal by one of forging process and casting process.

61. The multi-functional tool as defined in claim 60, wherein said metal is one of steel, zinc alloy, aluminum and aluminum bronze.

62. The multi-functional tool as defined in claim 1, wherein said drive mechanism further includes a first rotatable member operably coupled to said power source, a second rotatable member operably connected to said worm gear and an endless drive member extending between said first and said second rotatable members to transfer torque from said first rotatable member to said second rotatable member.

63. The multi-functional tool as defined in claim 62, wherein said head body member of said first head unit a unitary single-piece part.

64. The multi-functional tool as defined in claim 63, wherein said head body member of said first head unit defines at least one compartment for housing one of said power source and said drive mechanism, said head body member further includes at least one head cover member removably secured to said head body member of said head tool unit for closing said at least one compartment.

65. The multi-functional tool as defined in claim 64, wherein said cover member includes an integral extended tab utilized to protect said first and said second rotatable members and said endless drive member.

66. The multi-functional tool as defined in claim 2, wherein said tool handle unit includes an adaptive handle unit and an extension handle unit removably attachable to said adaptive handle unit.

67. The multi-functional tool as defined in claim 66, wherein said adaptive handle unit includes an adaptive handle body member having at least one fitting portion; and wherein said extension handle unit includes an extension handle body member having at least one fitting portion so that said extension handle unit is removably attachable to said adaptive handle unit by mechanically coupling said at least one fitting portion of said extension handle unit to said at least one fitting portion of said adaptive handle unit through an adaptive extension member provided to matingly engage said fitting portions of both said extension handle unit and said adaptive handle unit.

68. The multi-functional tool as defined in claim 67, wherein said adaptive handle body member of said adaptive handle unit is a unitary single-piece part.

69. The multi-functional tool as defined in claim 68, wherein said adaptive handle body member of said adaptive handle unit defines at least one compartment for housing one of said at least one battery and said control switch assembly, said adaptive handle body member further including at least one handle cover member removably secured to said adaptive handle body member of said adaptive handle unit for closing said at least one compartment.

70. The multi-functional tool as defined in claim 66, wherein a combination of said adaptive handle unit and said extension handle unit forms an extended handle to establish reach and leverage and to facilitate placement of the desired location of the said tool handle and said switch in relation to the combined said extension handles.

71. The multi-functional tool as defined in claim 66, wherein said adaptive handle unit includes a first fitting portion and a second fitting portion provided at the opposite ends of said adaptive handle unit, and wherein said extension handle unit includes a first fitting portion and a second fitting portion provided at the opposite ends of said extension handle unit.

72. The multi-functional tool as defined in claim 71, further including a finishing end piece removably attached to the distal end of one of said adaptive power tool handle unit and said extension handle unit via an integral bottom post and detents.

73. The multi-functional tool as defined in claim 72, wherein said finishing end piece has a through slot for hanging purposes and for attaching a wrench tether thereto, and connect to a belt loop for easy access and transporting.

74. The multi-functional tool as defined in claim 71, wherein said extension handle unit is removably attachable to said adaptive handle unit by mechanically coupling one of said first and second fitting portions of said extension handle unit to said one of said first and second fitting portions of said adaptive handle unit through an adaptive extension member provided to matingly engage said fitting portions of both said extension handle unit and said adaptive handle unit.

75. The multi-functional tool as defined in claim 74, wherein said adaptive handle unit includes at least one electric battery disposed in said adaptive handle body member of said adaptive handle unit.

76. The multi-functional tool as defined in claim 75, wherein said adaptive handle unit further includes a control switch assembly disposed in said adaptive handle body member of said adaptive handle unit and electrically connected to said at least one electric battery.

77. The multi-functional tool as defined in claim 76, wherein said adaptive handle unit includes an electric handle connector electrically coupled to said at least one battery through said control switch assembly, and wherein said first head unit includes an electric head connector complementary to said electric handle connector.

78. The multi-functional tool as defined in claim 77, wherein said electric handle connector includes one of a single male pin and a complimentary single female pin, and said electric head connector includes the other one of said single male pin and said single female pin; said single female pin is adapted to receive said single male pin.

79. The multi-functional tool as defined in claim 77, wherein said electric handle connector is disposed adjacent to one of said first and second fitting portions of said adaptive handle unit.

80. The multi-functional tool as defined in claim 77, wherein said extension handle unit includes at least one electric handle connector provided to be electrically coupled to said electric handle connector of said adaptive handle unit through said adaptive extension member.

81. The multi-functional tool as defined in claim 80, wherein said adaptive extension member is a unitary single-piece elongated post, having at least one connectively internal electrical connector, said electrical connector is openly accessible and matingly receivable at opposing ends, and wherein at least two detents laterally spaced on an outer peripheral surface provided to be matingly received mechanically and electrically in mating cavities of said mating fitting portions of both the said adaptive handle unit and said extension handle unit.

82. The multi-functional tool as defined in claim 77, wherein said extension handle unit includes a pair of electric handle connectors each provided to be electrically coupled to said electric handle connector of said adaptive handle unit through said adaptive extension member.

83. The multi-functional tool as defined in claim 82, further comprising a power source driving said drive mechanism, said power source disposed in one of said handle unit and said first head unit.

84. The multi-functional tool as defined in claim 83, wherein said power source includes a reversible electric motor.

85. The multi-functional tool as defined in claim 84, wherein said power source includes a gearbox drivingly coupled to said reversible electric motor.

86. The multi-functional tool as defined in claim 83, wherein said first head unit includes an electric head connector complementary to said electric handle connector of said adaptive handle unit and each said electric handle connectors of said extension handle unit and is provided to electrically connect said control switch assembly to said power source for selectively supplying electrical current form said at least one battery to said power source when said first head unit is coupled to said tool handle unit.

87. The multi-functional tool as defined in claim 77, wherein said electric handle connector includes one of a pair of male pins and a complimentary pair of female pins, and said electric head connector includes the other one of said pair of male pins and said pair of female pins; said pair of female pins is adapted to receive said pair of male pins.

88. The multi-functional tool as defined in claim 67, wherein said extension handle body member of said extension handle unit is a unitary single-piece part.

89. The multi-functional tool as defined in claim 88, wherein said extension handle body member of said extension handle unit is made of metal by one of forging process and casting process.

90. The multi-functional tool as defined in claim 89, wherein said metal is one of steel, zinc alloy, aluminum and aluminum bronze.

91. The multi-functional tool as defined in claim 88, wherein said extension handle body member of said extension handle unit is made of plastic material by an injection molding process.

92. The multi-functional tool as defined in claim 67, wherein said adaptive extension member is a unitary single-piece elongated post incorporating at least two detents laterally spaced on an outer peripheral surface provided to be matingly received mechanically in mating cavities of said mating fitting portions of both the said adaptive handle unit and said extension handle unit.

93. The multi-functional tool as defined in claim 68, wherein said adaptive handle body member of said adaptive handle unit is made of plastic material by an injection molding process.

94. The multi-functional tool as defined in claim 68, wherein said adaptive handle body member of said adaptive handle unit is made of metal by one of forging process and casting process.

95. The multi-functional tool as defined in claim 94, wherein said metal is one of steel, zinc alloy, aluminum and aluminum bronze.

96. The multi-functional tool as defined in claim 2, wherein said adjustable jaw wrench of said first head unit includes a scale device in the form of a numeric scale provided for measuring a wrench jaw opening.

97. The multi-functional tool as defined in claim 96, wherein said numeric scale is one of a metric scale and a British scale.

98. The multi-functional tool as defined in claim 96, wherein said movable jaw includes a marker provided adjacent to said numeric scale.

99. The multi-functional tool as defined in claim 2, wherein said handle body member of said tool handle unit includes a through slot at the distal end thereof for hanging purposes and for attaching a wrench tether thereto, and connect to a belt loop for easy access and transporting.

100. The multi-functional tool as defined in claim 1, wherein said power source includes a fluid motor driven by a pressurized fluid.

101. The multi-functional tool as defined in claim 1, wherein said power source includes a gearbox drivingly coupled to a reversible fluid motor.

102. The multi-functional tool as defined in claim 101, wherein said handle unit is connected to a source of fluid pressure by an externally supplied hydraulic pump or air compressor.

103. A multi-functional tool comprising:

a tool handle unit including a handle body member having a fitting portion; and a first tool head unit removably attachable to said handle unit;

said first head unit having a first fitting member provided to matingly engage said fitting portion of said handle unit so as to removably secure said first head unit to said handle unit;

wherein said first head unit is an adjustable jaw wrench comprising:

a head body member defining a stationary jaw;

a movable jaw reciprocally mounted to said head body member in alignment with said stationary jaw, said movable jaw including a gear rack portion; and a drive mechanism mounted to said head body member of said first head unit, said drive mechanism being operably coupled to said movable jaw for moving said movable jaw relative to said stationary jaw, said drive mechanism including a worm gear rotatably mounted in said head body, said worm gear engaging said gear rack portion of said movable jaw; and a first power source selectively driving said drive mechanism; said first power source disposed in said handle unit;

wherein said fitting portion of said tool handle unit includes first and second mating cavities in said handle body member, and wherein said first fitting member of said first head unit includes a first elongated mating post extending from said head body member complementary to and provided to be matingly received in said first mating cavity in said handle body member so as to removably secure said first head unit to said tool handle unit; and wherein said first elongated post of said first tool head units incorporates at least one detent formed on an outer peripheral surface thereof, and said first mating cavity in said handle body member is provided with at least one locking member releasably engaging said at least one detent to secure said first head unit to said tool handle unit.

104. The multi-functional tool as defined in claim 103, wherein said handle unit of said multi-functional tool includes at least one electric battery disposed in said handle body member of said handle unit.

105. The multi-functional tool as defined in claim 104, wherein said first power source includes a reversible electric motor.

106. The multi-functional tool as defined in claim 105, wherein said first power source includes a gearbox drivingly coupled to said reversible electric motor.

107. The multi-functional tool as defined in claim 106, wherein said tool handle unit includes a mechanical handle coupling device operatively coupled to an output shaft of said first power source.

108. The multi-functional tool as defined in claim 107, wherein said mechanical handle coupling device is disposed in said first mating cavity of said handle body member.

109. The multi-functional tool as defined in claim 107, wherein said first head unit includes a mechanical head coupling device operatively coupled to said drive mechanism, and wherein said head coupling device is complementary to said handle coupling device and is provided to drivingly couple said power source to said drive mechanism when said first head unit is coupled to said tool handle unit.

110. The multi-functional tool as defined in claim 107, further including a control switch assembly disposed in said handle body member of said handle unit and electrically connected to said at least one electric battery for controlling said power source.

111. The multi-functional tool as defined in claim 110, wherein said control switch assembly includes two single pole double throw switches and a switch actuator.

112. The multi-functional tool as defined in claim 110, wherein said control switch assembly includes a single double pole double throw switch and a switch actuator.

113. The multi-functional tool as defined in claim 110, further comprising an independent on/off control switch disposed in said handle body member of said handle unit and electrically connected to said at least one electric battery for controlling said power source.

114. The multi-functional tool as defined in claim 113, further comprising a second power source disposed in said first head unit.

115. The multi-functional tool as defined in claim 114, wherein said second power source includes a reversible electric motor.

116. The multi-functional tool as defined in claim 115, wherein said second power source includes a gearbox drivingly coupled to said reversible electric motor.

117. The multi-functional tool as defined in claim 114, wherein said tool handle unit further includes an electric handle connector electrically coupled to said at least one battery through said control switch assembly and said.

118. The multi-functional tool as defined in claim 117, wherein said first head unit includes an electric head connector complementary to said electric handle connector and is provided to electrically connect said control switch assembly to said second power source for selectively supplying electrical current form said at least one battery to said second power source when said first head unit is coupled to said tool handle unit.

119. The multi-functional tool as defined in claim 118, wherein said electric head connector includes at least one female pin connector or male pin connector disposed in said first head body member and said complimentary electric handle connector includes at least one male pin connector or one female pin connector disposed in said handle body member.

120. The multi-functional tool as defined in claim 118, wherein said first fitting member of said first head unit further includes a second elongated mating post extending from said head body member complementary to and provided to be matingly received in said second mating cavity in said handle body member so as to removably secure said first head unit to said tool handle unit, and wherein said electric handle connector is disposed in said second mating cavity in said tool handle unit, and said electric head connector is disposed in said second elongated mating post of said first fitting member of said first head unit.

121. The multi-functional tool as defined in claim 118, further comprising a second tool head unit having a second fitting member provided to matingly engage said fitting portion of said handle unit so as to removably secure said second head unit to said handle unit; wherein said second fitting member of said second head unit includes first and second elongated mating posts extending from a second head body member complementary to and provided to be matingly received in said first and second mating cavities in said handle body member so as to removably secure said second head unit to said tool handle unit.

122. The multi-functional tool as defined in claim 121, wherein said second tool head unit includes at least one illumination device connected to said at least one battery in said tool handle unit through said control switch assembly and said independent on/off control switch.

123. The multi-functional tool as defined in claim 122, wherein said second tool head unit includes an electric head connector provided in said second elongated mating post of said second fitting member of said second head body member; said electric head connector is electrically connected to at least one illumination device of said second tool head unit.

124. The multi-functional tool as defined in claim 118, further comprising a third tool head unit having a third head body member provided with a third fitting member provided to matingly engage said fitting portion of said handle unit so as to removably secure said third head unit to said handle unit; wherein said third fitting member of said third head unit includes first and second elongated mating posts extending from said third head body member complementary to and provided to be matingly received in said first and second mating cavities in said handle body member so as to removably secure said third head unit to said tool handle unit.

125. The multi-functional tool as defined in claim 124, wherein said third tool head unit includes an electric head connector in the said third fitting member of said third head body member and said electric head connector is electrically connected to at least one illumination device of said third tool head unit connected to said at least one battery in said tool handle unit through said control switch assembly and said independent on/off control switch, and wherein said third tool head unit includes a mechanical head coupling device in the said third fitting member of said third head body member.

126. The multi-functional tool as defined in claim 125, wherein said mechanical coupling device incorporates a power take-off shaft with said power take-off shaft connected to an eccentric disc rotatable and supported within the said third head body member of the said third tool head unit.

127. The multi-functional tool as defined in claim 118, further comprising a fourth tool head unit having a fourth head body member provided with a fourth fitting member provided to matingly engage said fitting portion of said handle unit so as to removably secure said fourth head unit to said handle unit; wherein said fourth fitting member of said fourth head unit includes a first elongated mating post extending from said fourth head body member complementary to and provided to be matingly received in said first mating cavity in said handle body member so as to removably secure said fourth head unit to said tool handle unit.

128. The multi-functional tool as defined in claim 127, wherein said fourth fitting member of said fourth tool head unit includes at least one illumination device and a mechanical head coupling device, wherein said mechanical coupling device incorporates an integral power take-off shaft with said power take-off shaft connected to a rotatable armature winding disc supported within said fourth head body member of the said fourth tool head unit.

129. The multi-functional tool as defined in claim 128, wherein said rotatable armature winding disc has at least two stationary opposing magnets spaced around the circumference of said armature winding disc.

130. The multi-functional tool as defined in claim 129, whereas the said armature winding disc and said opposing magnets of the said fourth tool head function as a generator provided to supply electrical current to said at least one illumination device.

* * * * *